US009635904B2

(12) United States Patent
Wakeland et al.

(10) Patent No.: US 9,635,904 B2
(45) Date of Patent: May 2, 2017

(54) INSOLES FOR FOOTWEAR

(71) Applicant: Superfeet Worldwide, Inc., Ferndale, WA (US)

(72) Inventors: Daniel Wakeland, Bellingham, WA (US); Matthew Gooch, Ferndale, WA (US)

(73) Assignee: Superfeet Worldwide, Inc., Ferndale, WA (US)

( * ) Notice: Subject to any disclaimer, the term of this patent is extended or adjusted under 35 U.S.C. 154(b) by 50 days.

(21) Appl. No.: 14/799,790

(22) Filed: Jul. 15, 2015

(65) Prior Publication Data

US 2016/0198794 A1 Jul. 14, 2016

Related U.S. Application Data

(60) Provisional application No. 62/103,492, filed on Jan. 14, 2015.

(51) Int. Cl.
*A43B 13/38* (2006.01)
*A43B 17/00* (2006.01)
(Continued)

(52) U.S. Cl.
CPC ..... *A43B 17/006* (2013.01); *A43B 7/14* (2013.01); *A43B 7/141* (2013.01); *A43B 7/142* (2013.01);
(Continued)

(58) Field of Classification Search
CPC ..... A43B 17/006; A43B 17/02; A43B 17/023; A43B 7/142; A43B 7/143; A43B 7/14; A43B 7/1485
(Continued)

(56) References Cited

U.S. PATENT DOCUMENTS 2,644,250 A * 7/1953 Ciaio ..... A43B 13/12 12/146 B
4,510,700 A * 4/1985 Brown ..... A43B 7/142 36/154
(Continued)

FOREIGN PATENT DOCUMENTS

DE 8304226.1 U1 6/1983
DE 19609177 A1 9/1997
EP 2210 513 A2 7/2010

OTHER PUBLICATIONS

Extended European Search Report dated Jun. 8, 2016, 9 Pages.

*Primary Examiner* — Ted Kavanaugh
(74) *Attorney, Agent, or Firm* — Lowe Graham Jones PLLC

(57) ABSTRACT

Embodiments are directed towards an insole assembly for an article of footwear. The insole includes a cushioning member and a support member. The cushioning member having an upper surface for engaging a plantar surface of a foot and a bottom surface for engaging a sole of the footwear and the support member. The support member engages with a portion of the bottom surface of the cushioning member. The support member has a rearfoot portion which extends around a heel end of the cushioning member, medial and lateral side portions which extend forwardly from the rearfoot portion on opposite sides of a central opening in the support member, and a front-end portion connecting the medial and lateral side portions near a midfoot region of the footwear enclosing the central opening in the support member along a perimeter of the cushioning member.

18 Claims, 31 Drawing Sheets

(51) Int. Cl.
*A43B 7/14* (2006.01)
*A43B 17/02* (2006.01)

(52) U.S. Cl.
CPC ..... *A43B 7/143* (2013.01); *A43B 7/1485* (2013.01); *A43B 17/02* (2013.01)

(58) Field of Classification Search
USPC ..... 36/44, 76 C
See application file for complete search history.

(56) References Cited

U.S. PATENT DOCUMENTS

| | | | | |
|---|---|---|---|---|
| 4,686,993 | A * | 8/1987 | Grumbine | A43B 7/141 36/140 |
| 5,146,698 | A * | 9/1992 | Tilles | A43B 13/40 36/178 |
| 6,233,847 | B1 | 5/2001 | Brown | |
| 8,479,413 | B2 * | 7/2013 | Avent | A43B 7/14 36/108 |
| 2002/0056208 | A1 * | 5/2002 | Brown | A43B 7/142 36/44 |
| 2008/0072461 | A1 * | 3/2008 | Howlett | A43B 7/142 36/145 |
| 2009/0049712 | A1 | 2/2009 | Steszyn et al. | |

* cited by examiner

INSOLES FOR FOOTWEAR

CROSS-REFERENCE TO RELATED APPLICATIONS

This application claims the benefit under 35 U.S.C. §119 (e) of U.S. Provisional Patent Application No. 62/103,492 titled "Insoles for Footwear" filed on Jan. 14, 2015, which is incorporated herein by reference.

TECHNICAL FIELD

The present invention relates generally to insoles for footwear, and more particularly, but not exclusively, to a contoured insole having a soft cushioning upper member and a rigid reinforcement support that cradles the cushioning member so as to provide support at predetermined areas of the insole and to reduce deformation of the front end of the cushioning member.

BACKGROUND

Cushioning insoles of various types are known for use in shoes, particularly for use in running shoes and other shoes intended for athletic activities. Typically, these insoles take the form of a relatively thin layer of foam material that rests atop the midsole of the shoe, and are often removable for washing or replacement.

While commonly used, conventional insoles of this general type typically have less than ideal characteristics in several respects. Firstly, the top surface of the foam material is often given a pronounced contour in an effort to support and cradle the wearer's foot, but because the foam is intended mainly to cushion the foot, it typically lacks sufficient strength and firmness to simultaneously provide the necessary support for proper biomechanical function of the foot, particularly in the rearfoot and arch areas. This problem can be aggravated by the fact that most athletic shoes are "soft sided" to a greater or lesser extent, i.e., the uppers are formed of cloth, vinyl, or other flexible materials, which yield outwardly under pressure, thereby providing very little inward buttressing around the insole. As a result, conventional contoured insoles tend to deform and "mush" downwardly and outwardly under the foot without providing any meaningful level of support, and also tend to break down and lose their shape over time. Accordingly, there exists a need for a lightweight, low-cost contoured insole that provides effective cushioning for a foot, but is nevertheless durable and long lasting in use. Thus, it is with respect to these considerations and others that the invention has been made.

BRIEF DESCRIPTION OF THE DRAWINGS

Non-limiting and non-exhaustive embodiments of the present invention are described with reference to the following drawings. In the drawings, like reference numerals refer to like components throughout the various figures unless otherwise specified.

For a better understanding of the present invention, reference will be made to the following Detailed Description, which is to be read in association with the accompanying drawings, wherein:

FIGS. 1A-1M illustrate various different views of a three-quarter-length cushioning insole assembly in accordance with embodiments described herein;

DETAILED DESCRIPTION

Figure 1A:
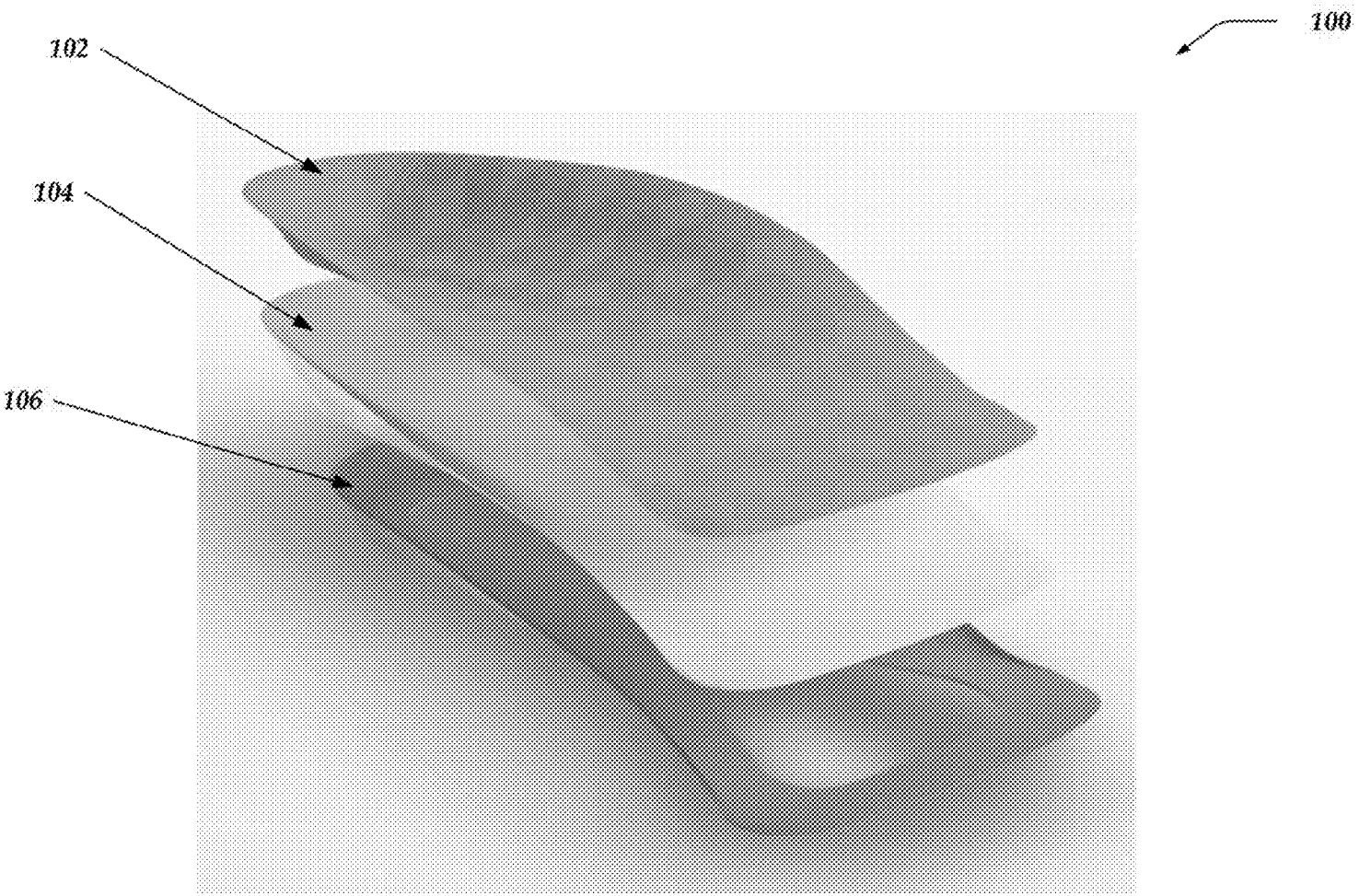

Various embodiments are described more fully hereinafter with reference to the accompanying drawings, which form a part hereof, and which show, by way of illustration, specific embodiments by which the invention may be practiced. The embodiments may, however, be embodied in many different forms and should not be construed as limited to the embodiments set forth herein; rather, these embodiments are provided so that this disclosure will be thorough and complete, and will fully convey the scope of the embodiments to those skilled in the art. The following detailed description should, therefore, not be limiting.

Throughout the specification and claims, the following terms take the meanings explicitly associated herein, unless the context clearly dictates otherwise. The term "herein" refers to the specification, claims, and drawings associated with the current application. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, the term "footwear" refers to articles to be worn on the feet of a consumer. Footwear may include, but is not limited to, shoes, boots, slippers, sandals, or the like. Similarly, footwear may include various types of footwear for a variety of different sporting or outdoor activities, including, but not limited to, running shoes, hiking shoes or boots, ski boots, snowboard boots, rock-climbing shoes, biking shoes, golfing shoes, track shoes/spikes, roller skates, ice skates, or the like. Although embodiments are generally described with reference to shoes, other types of footwear may also be utilized in embodiments described herein. A pair of shoes may include both an article of footwear for a left foot (i.e., a left-foot shoe) and an article of footwear for a right foot (i.e., a right-foot shoe).

As used herein, the term "insole" refers to an insert in footwear that is configured and arranged such that a bottom of the insole engages a sole (or midsole or material covering the top of the midsole) of a shoe and a top of the insole engages a wearer's foot (with or without a sock). The insole may also be an orthotic.

GENERAL DESCRIPTION

In various embodiments, the insole assembly described herein may also be referred to as the insole or the assembly. The insole shown in all the figures is for a right-foot shoe, and it will be understood that the left-foot assembly is the substantially mirror image identical thereto. Additionally, the dimensions of the insoles may be varied based on the associated shoe size (e.g., length and width) and/or the gender of the wearer of the associated shoes and insole. For example, FIGS. 1A-1M and FIGS. 3A-3G may illustrate a right-side insole for a male shoe, and FIGS. 2A-2K may illustrate a right-side insole for a female shoe.

As will be described in greater detail below, the orthotic assembly described herein includes both soft and rigid components, which cooperate to maintain the contoured shape of the device without relying on significant inward buttressing from the shoe upper in some embodiments. Other embodiments rely on some shoe upper support; indeed, in some embodiments the insole is adaptable and held in place to differing widths, as dictated by the shoe upper. As a result, the assembly is durable and particularly adapted to use in athletic shoes, and the contour and shape is maintained without having to compromise the cushioning that is afforded by the device. Furthermore, the components are configured to provide varying degrees of rigidity/support in those areas where it is needed for proper biomechanical operation of the foot, and to provide graduated transitions between these areas that correspond to changes in downward pressure under the foot as it progresses through the gait cycle.

FIGS. 1A-1M illustrate a right-side three-quarter length insole for a male shoe. A three-quarter length insole may be preferred in a dress shoes, for example. FIG. 1A is a perspective, exploded view of a cushioning insole in accordance with embodiments described herein. As can be seen in FIG. 1A, the components that make up the insole assembly 100 are an upper, cushioning member 104, and a lower, generally rigid support member 106. In various embodiments, the upper, cushioning member 104 described herein may also be referred to as the cushioning member (or as a blank or blank member). In various embodiments, the lower, generally rigid support member 106 described herein may also be referred to as the support or support member. In some embodiments, the insole 100 may also include a top cover 102. This top cover 102 may be a fabric material that can aid in comfort of the insole 100, sweat or odor control, or the like. In various embodiments, the top cover 102 may be adhered to the cushioning member 104.

The body of the cushioning member 104 is formed of a cushioning material, such as open-cell or closed-cell foam. The cushioning member 104 will generally extend from a rear of an underlying shoe sole to a midfoot portion behind and/or near the metatarsal heads of a wearer's foot. In some embodiments, this length may be referred to as a three-quarter length of the underlying shoe sole. Although it will be understood that in some embodiments the cushioning member 104 may extend more or less than the three-quarter length, such as illustrated in FIGS. 3A-3G.

The upper surface of the cushioning member 104 is contoured to engage and cradle the plantar surface of a person's foot. The bottom surface of the cushioning member 104 is generally flat but with similar planar contours as the top surface of the support member 106 so that the cushioning member 104 along with the support member 106 match and rest on top of a standard shoe sole in a stable manner. A thin, substantially flat midfoot portion of the cushioning member 104 extends generally in the transverse plane at the front of the member, while the rearward end includes a downwardly concave heel cup portion to engage the heel of a wearer's foot.

The rigid support member 106, in turn, is configured and arranged to cooperate with the cushioning member 104, which is described in more detail below. In general, the support member 106 in conjunction with the cushioning member 104 maintains the shape of the insole 100 without relying on inward buttressing from the shoe, and also to provide optimized support for different parts of the foot. Although in some embodiments, a narrow shoe upper may compress the sides of the support member slightly inward, the insole being able to accommodate shoe uppers of various widths and sloping contours.

As can be seen in FIGS. 1B-1F, the support member 106 is a comparatively thin, bifurcated, component that extends a perimeter of the cushioning member 104 such that it extends around the rearfoot end 116 of the cushioning member 104, forwardly along the medial and lateral sides thereof, and then extends under the front end of the cushioning member 104, which provides support along the entire perimeter of the cushioning member 104. The support member 106 may be made of nylon plastic, but other injection-molded plastics may also be utilized to provide more or less rigidity depending on engineering judgment. The materials utilized for the support member 106 may be determined based on their characteristics for being relatively light in weight yet possesses sufficient strength and rigidity.

Figure 1B:
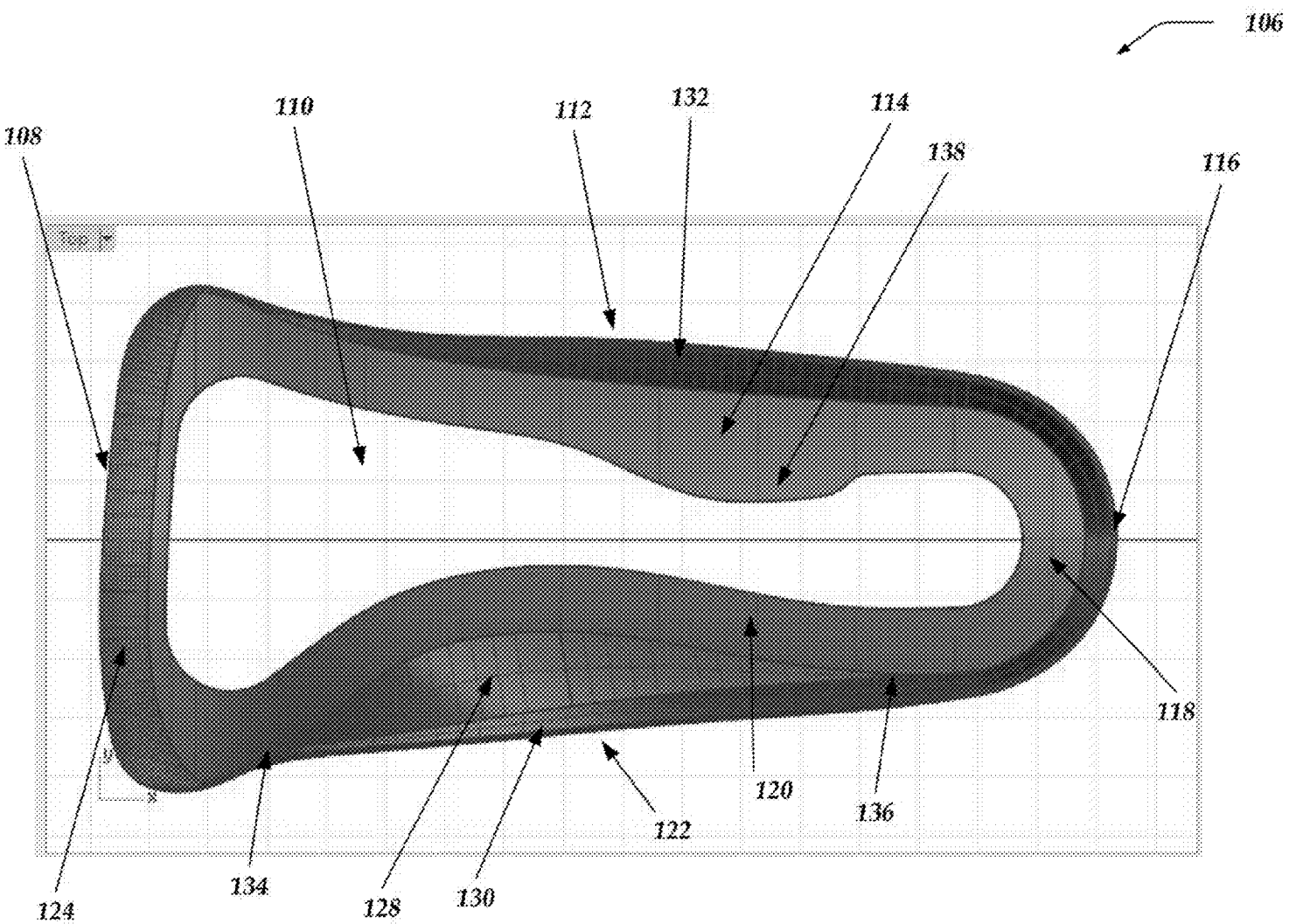

FIGS. 1B-1F illustrate various views of support member 106. FIG. 1B is a top, plan view of the support member of the insole of FIG. 1. The support member 106 itself includes medial and lateral upstanding walls (medial wall 130 and lateral wall 132) that extend along the medial and lateral sides of the cushioning member 104 and around the cushioning member's rearfoot end at rearfoot end 116. First flange portion (medial flange portion 120) and second flange portions (lateral flange portion 114) extend inwardly from the bottom edges of the sidewall portions (medial wall 130 and lateral wall 132), respectively, and are connected at the rear by a rearfoot flange 118 and at the front by a front-end (midfoot) flange 124.

The wall of the support member 106 may be generally highest on the medial side 122 near the arch area (or arch transition portion 128) and tapers downward towards the front end of the member and around the heel end along the lateral side 112 of the members. This additional wall height can provide additional support to the support member 106, which may be beneficial since there is no hard edge beneath the arch due to the shape of the arch transition portion 128.

The rearfoot flange 118 may be generally U-shaped such that it extends around the heel end of the device so as to partially surround the heel cup portion of the cushioning member 104. The rearfoot flange 118 extends into medial flange portion 120 on one side of the support member 106 and lateral flange 114 on the other side.

The medial flange portion 120 extends from the rearfoot flange 118 to the front-end flange 124 along the medial side 122 into the front-end flange 124. Moreover, the lateral flange 114 extends from the rearfoot flange 118 along the lateral side 112 into the front-end flange 124.

The front-end flange 124 may be relatively flat laterally across the midfoot area under the cushioning member 104 so as to engage the front end of the cushioning member 104. In various embodiments, the front of the front-end flange 124 may extend forward of a front end of the cushioning member 104 so that the front end 108 of the support member 106 is forward of the front end of the cushioning member 104.

In some embodiments, at least a portion of the front-end flange 124 may taper towards the forefoot to improve a wearer's comfort and to not impede the removal of the shoe from the wearer's foot. At least the front-end flange 124 may be adhered to the cushioning member 104 to reduce the possibility of the cushioning member 104 curling upward. This curling action can occur when without the front-end 108 of the support member 106—a wearer's foot catches the front end of the cushioning member 104 upon removal of their foot from the shoe. Each time the wearer's foot catches the front end of the cushioning member 104, the front end may have a tendency to curl upward, which can make the insole uncomfortable and potentially damage the insole over time.

The arch side (or medial side 122) includes an arch transition portion 128 between the medial side wall 130 and the medial flange 120 such that the arch transition portion 128 slopes downwardly from the medial side wall 130 at the outside of the support member 106 to the medial flange portion 120 at the bottom (adjacent to the top of the sole of the wearer's shoe) of the support member 106. In various embodiments, the arch transition portion 128 may be concave along the wearer's arch from a front position 134 to a rear position 136 on the medial side 122. In some embodiments, front position 134 may be rearward of front-end flange 124, and rear position 136 may be forward of rearfoot flange 118. This arch transition, along with the central open area 110 enable the insole 100 to flex laterally to more easily fit into narrower shoes (i.e., shoes with an internal width at the arch that is narrower than the width at the arch of the insole) or shoes with internally sloping sides, while also providing sufficient support for a wearer's foot in wider shoes (i.e., shows with an internal width at the arch that is wider than the width at the arch of the insole).

The medial flange 120, lateral flange 114, and rearfoot flange 118 may be a relatively uniform width along the shoe sole. The medial flange 120 and the lateral flange 114 may be arcuate and converge towards longitudinal centerline of the insole to create an hourglass-like shape, but that the medial flange 120 and the lateral flange 114 remain separated by a central open area 110. In some embodiments, the medial flange 120 may have a more pronounced arcuate shape than the lateral flange 114. The hourglass-shaped medial and lateral sides can make the insole compatible with a larger variety of shoes than an insole with medial and lateral sides that are relatively parallel. This is especially beneficial for enabling the insole to be used in narrower shoes and/or internally contoured shoes.

In some embodiments, the lateral flange portion 114 may include an extended flange portion 138 to further engage the bottom surface of the cushioning member 104. This extended flange portion generally has arcuate inner edges that converge towards the longitudinal centerline of the assembly, but still remain separated from the medial flange 120 by the central open area 110. In this way, the cushioning member 104 can engage a sole or midsole of the shoe through the central open area 110.

Figure 1C:
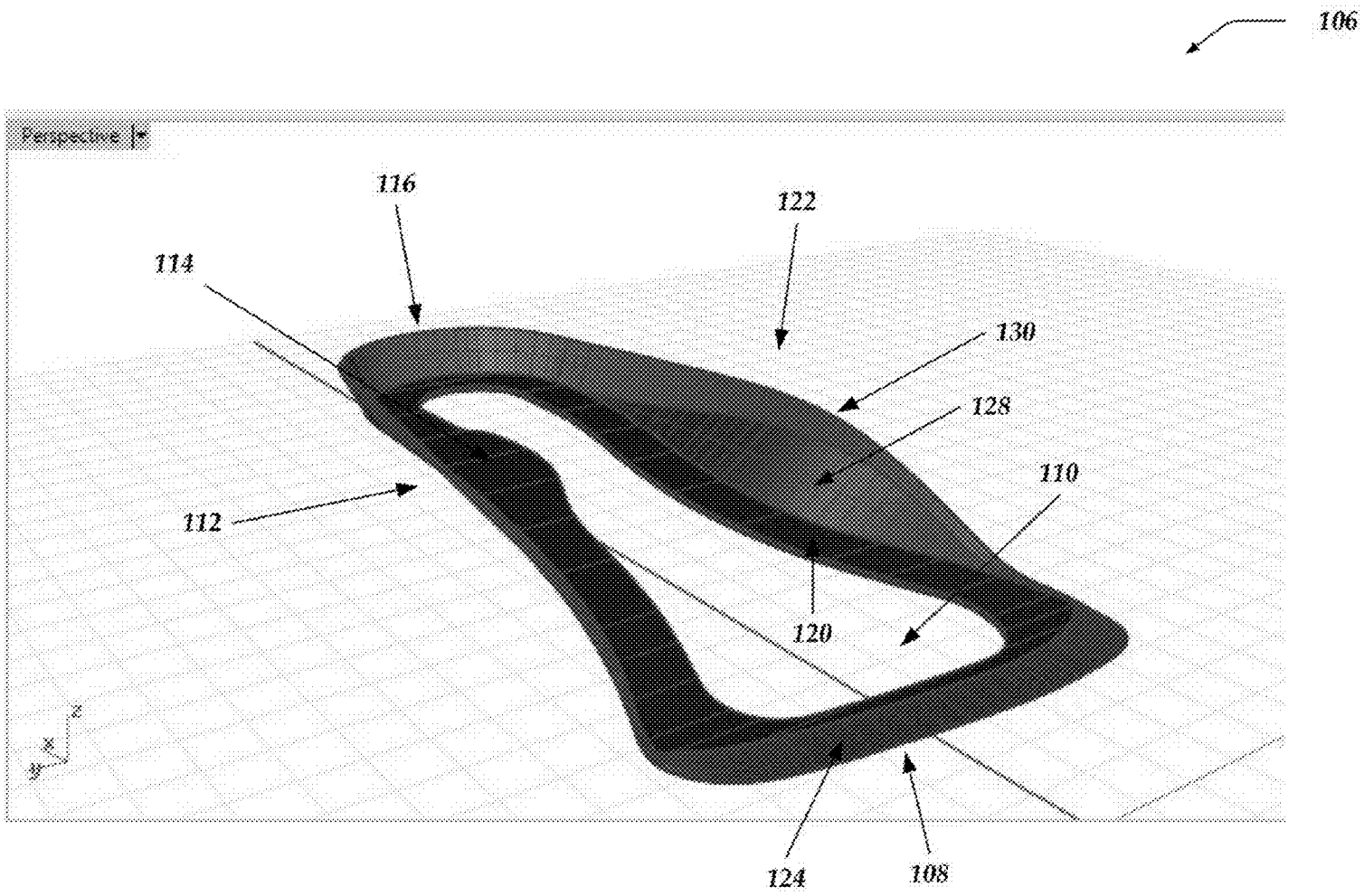
Figure 1D:
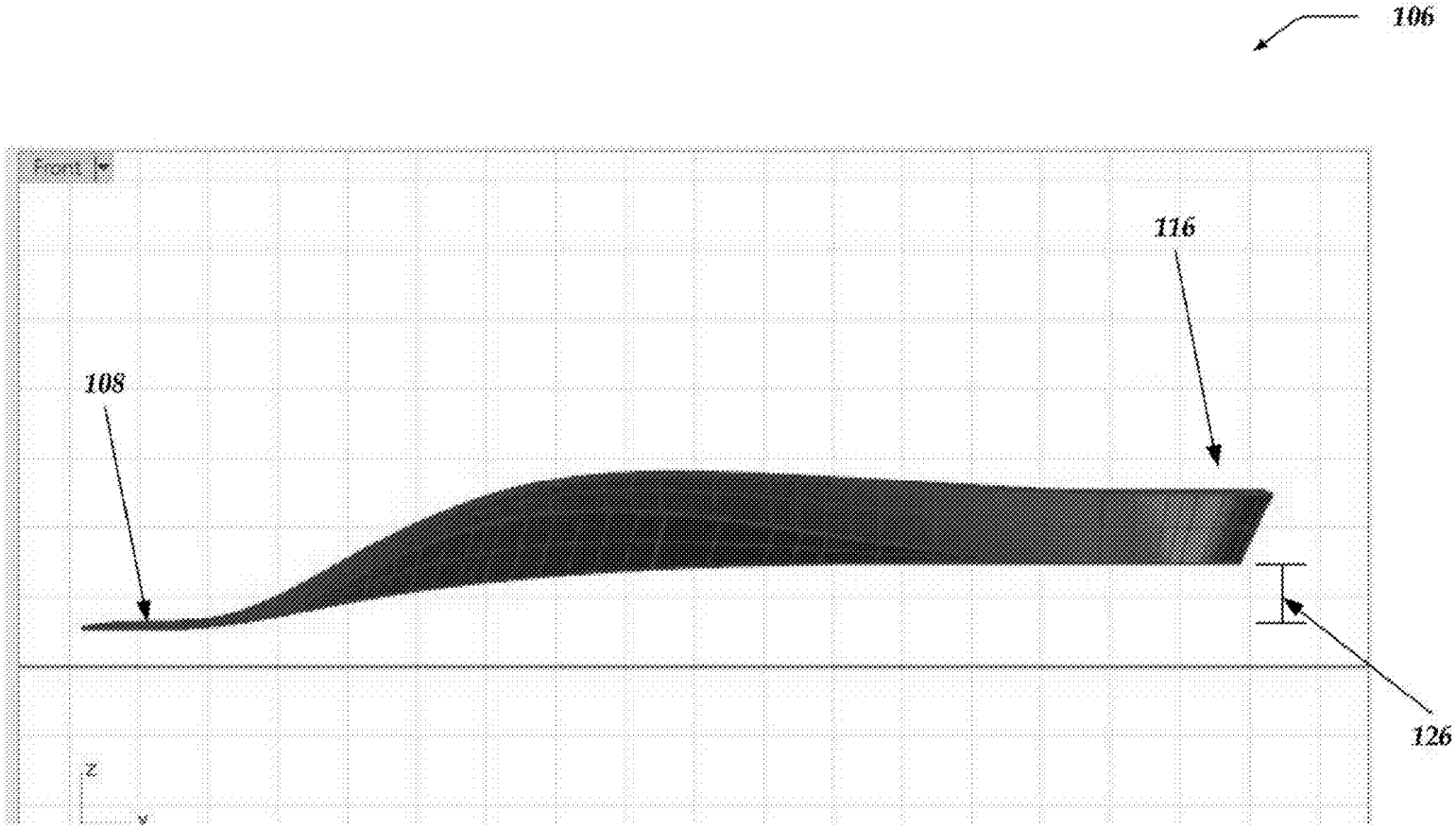

In some embodiments, the support member 106 may slightly curve downward from the rearfoot portion 116 to the front-end portion 108, as can be seen in FIG. 1D. This slight curvature can create an elevated heel portion 126, which acts like a spring when a wearer applies weight to the insole.

Figure 1E:
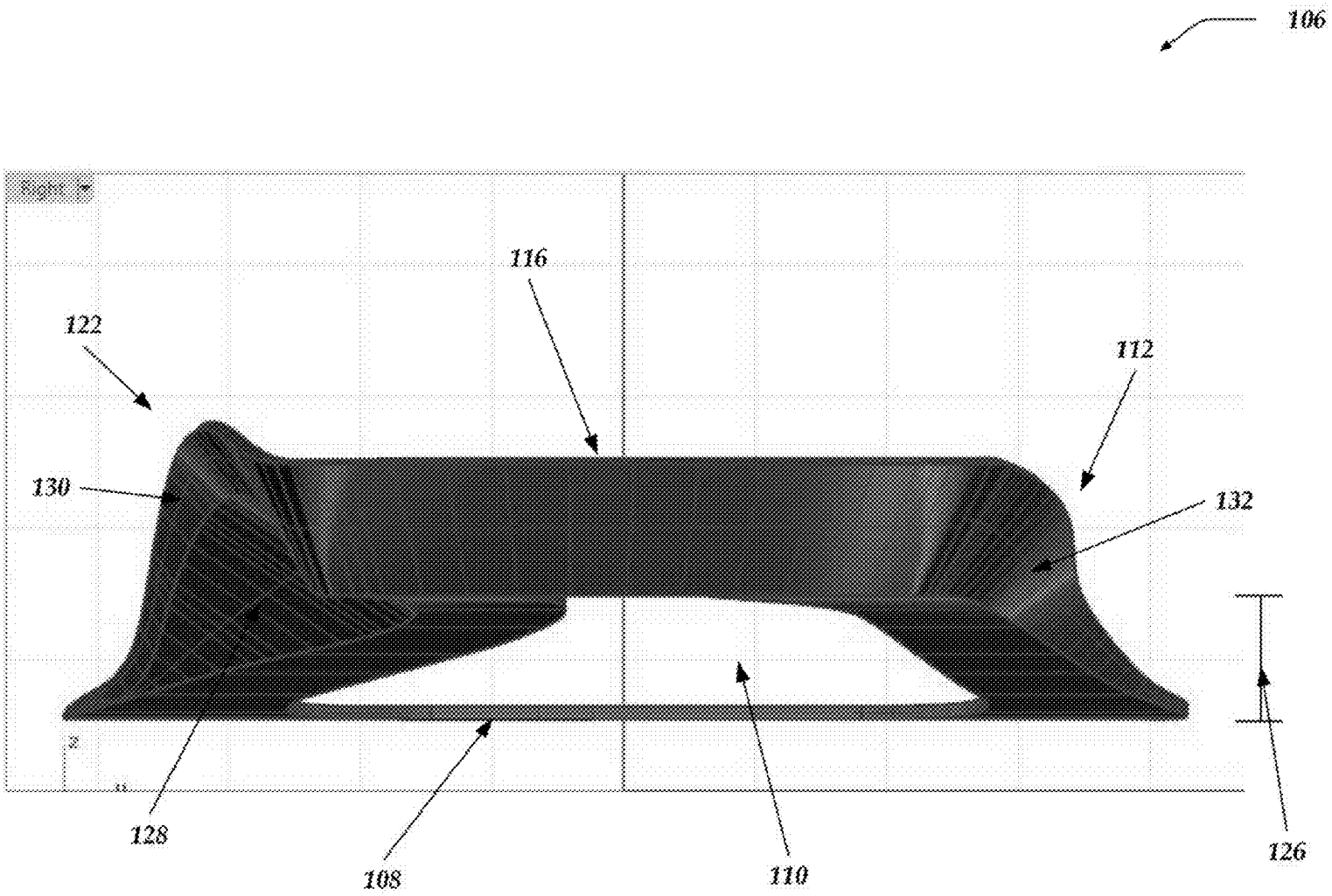
Figure 1F:
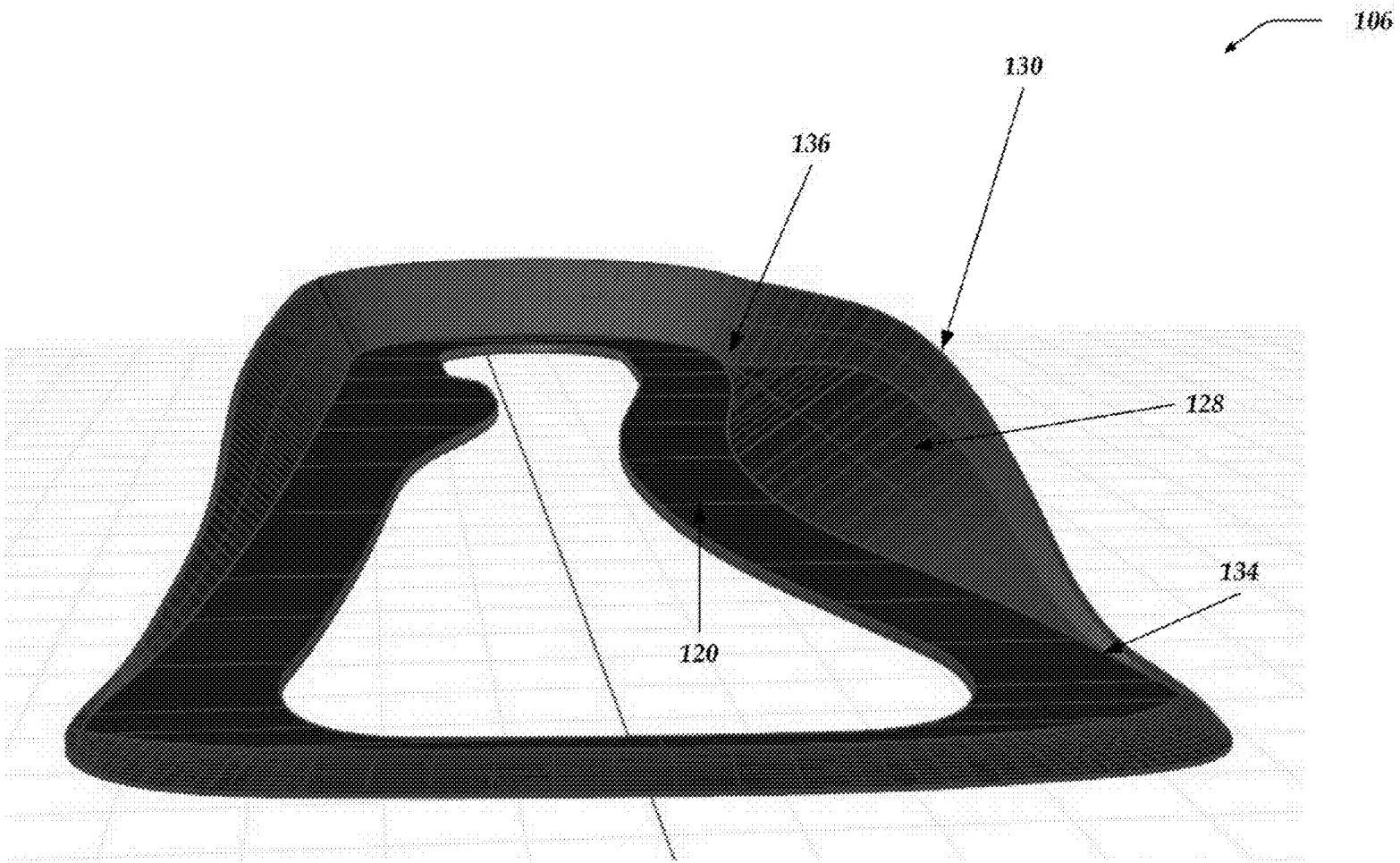

FIG. 1C is a top, perspective view of support member 106 of insole 100. FIG. 1D is a left side, elevational view of the support member 106 of insole 100. FIG. 1E is a rear, elevational view of the support member 106 of insole 100. FIG. 1F is a front, off-axis elevational view of the support member 106 of insole 100. These figures show the various components of the insole from different views.

Figure 1G:
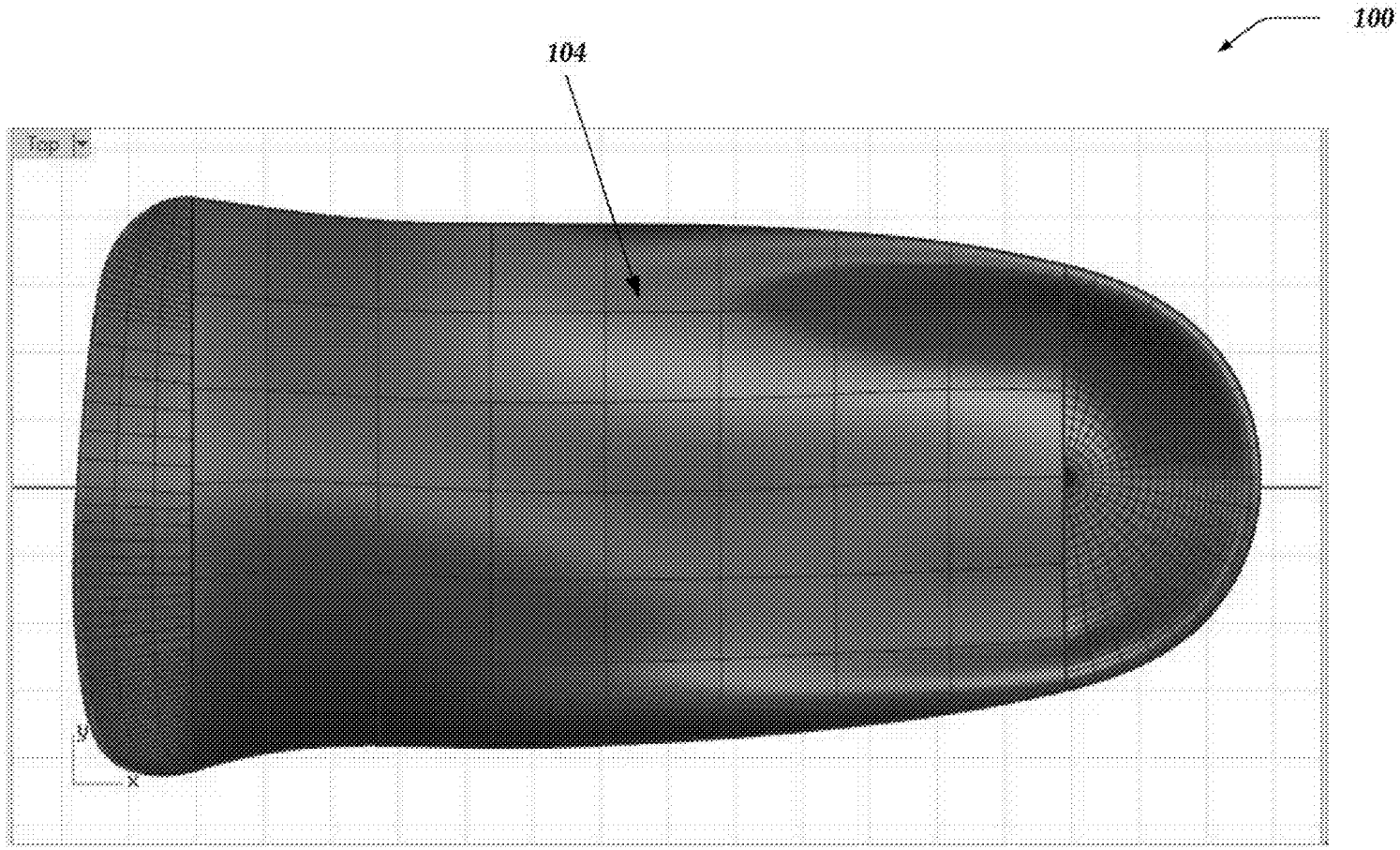
Figure 1H:
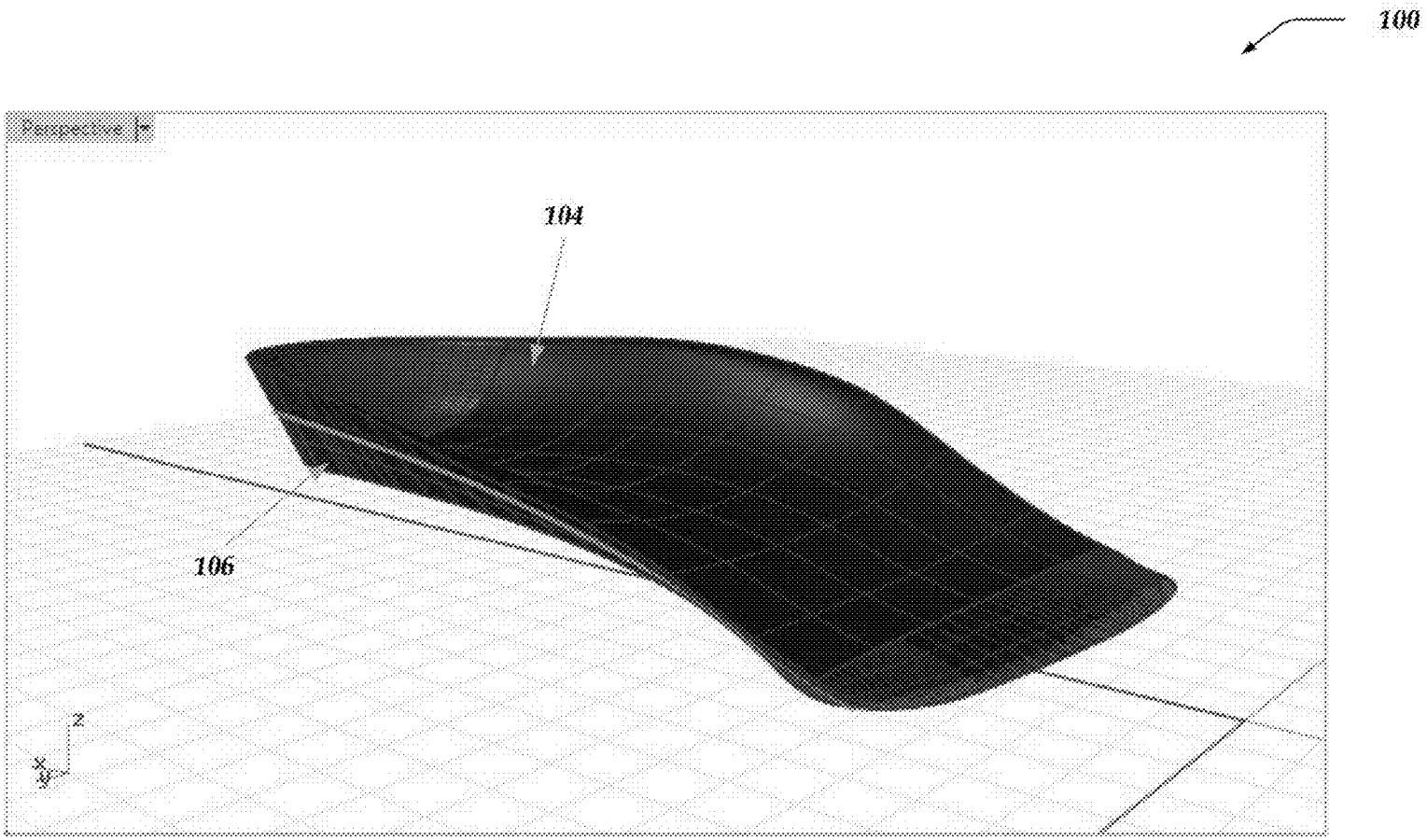
Figure 11:
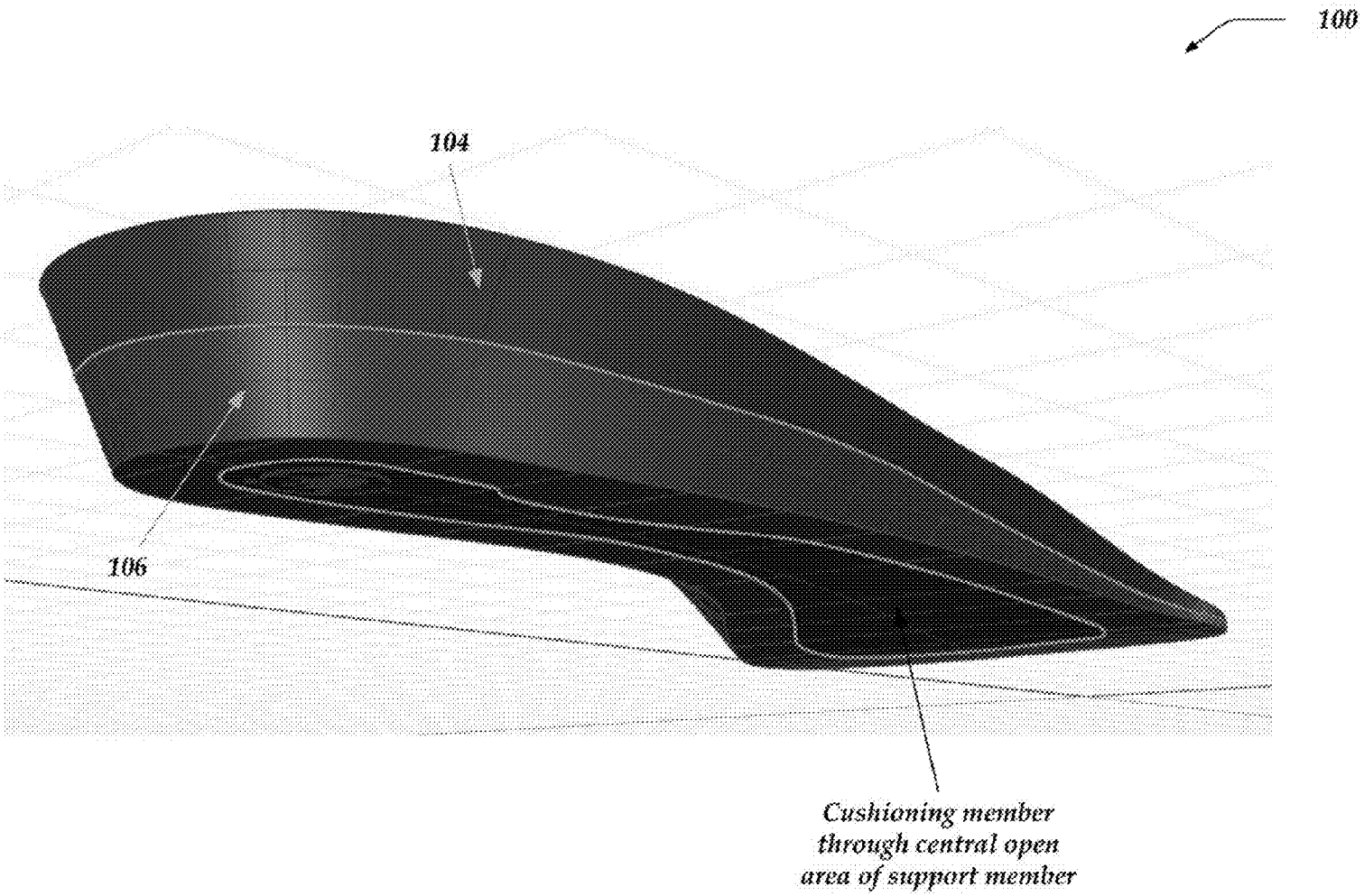
Figure 1J:
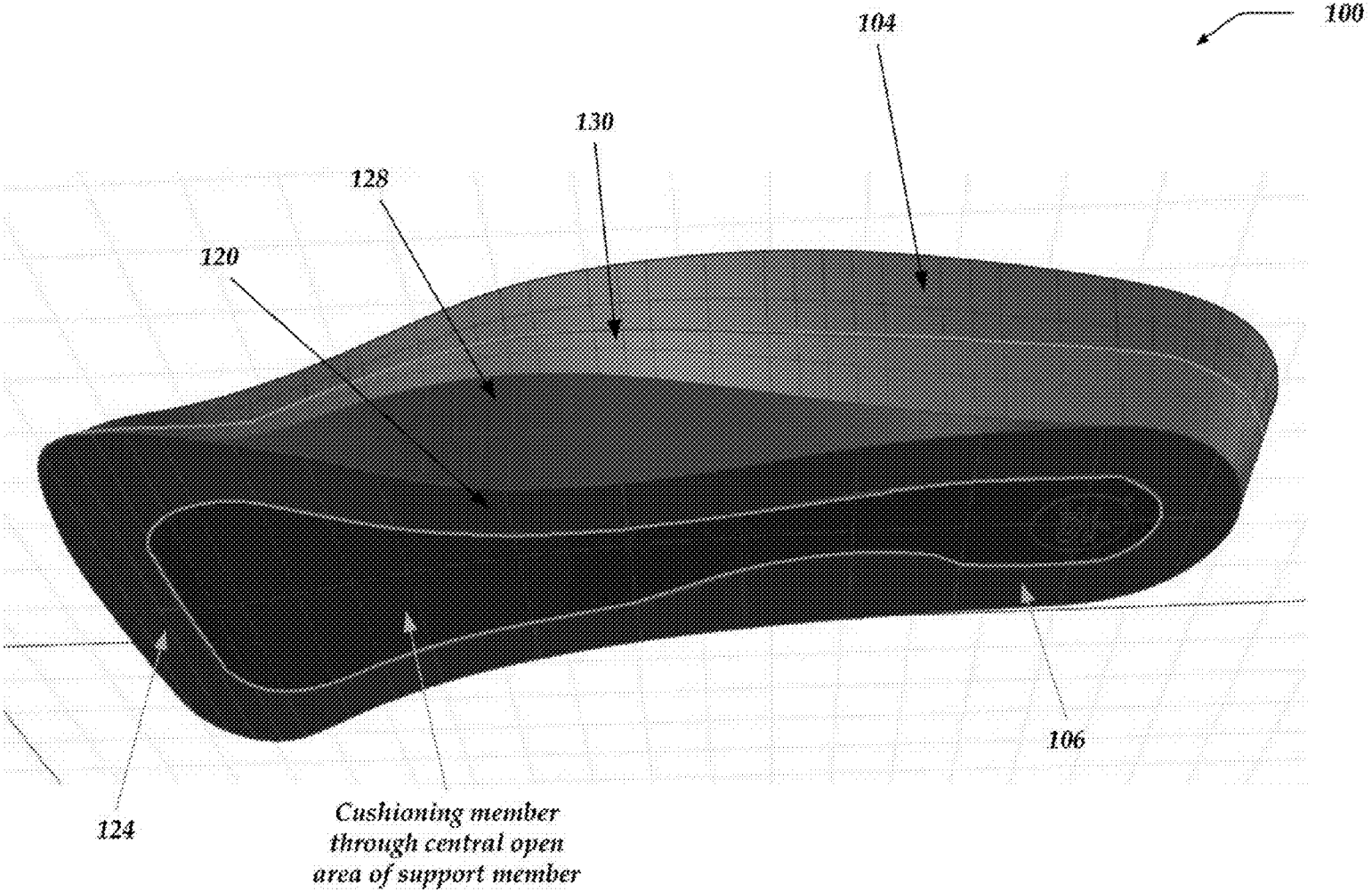
Figure 1K:
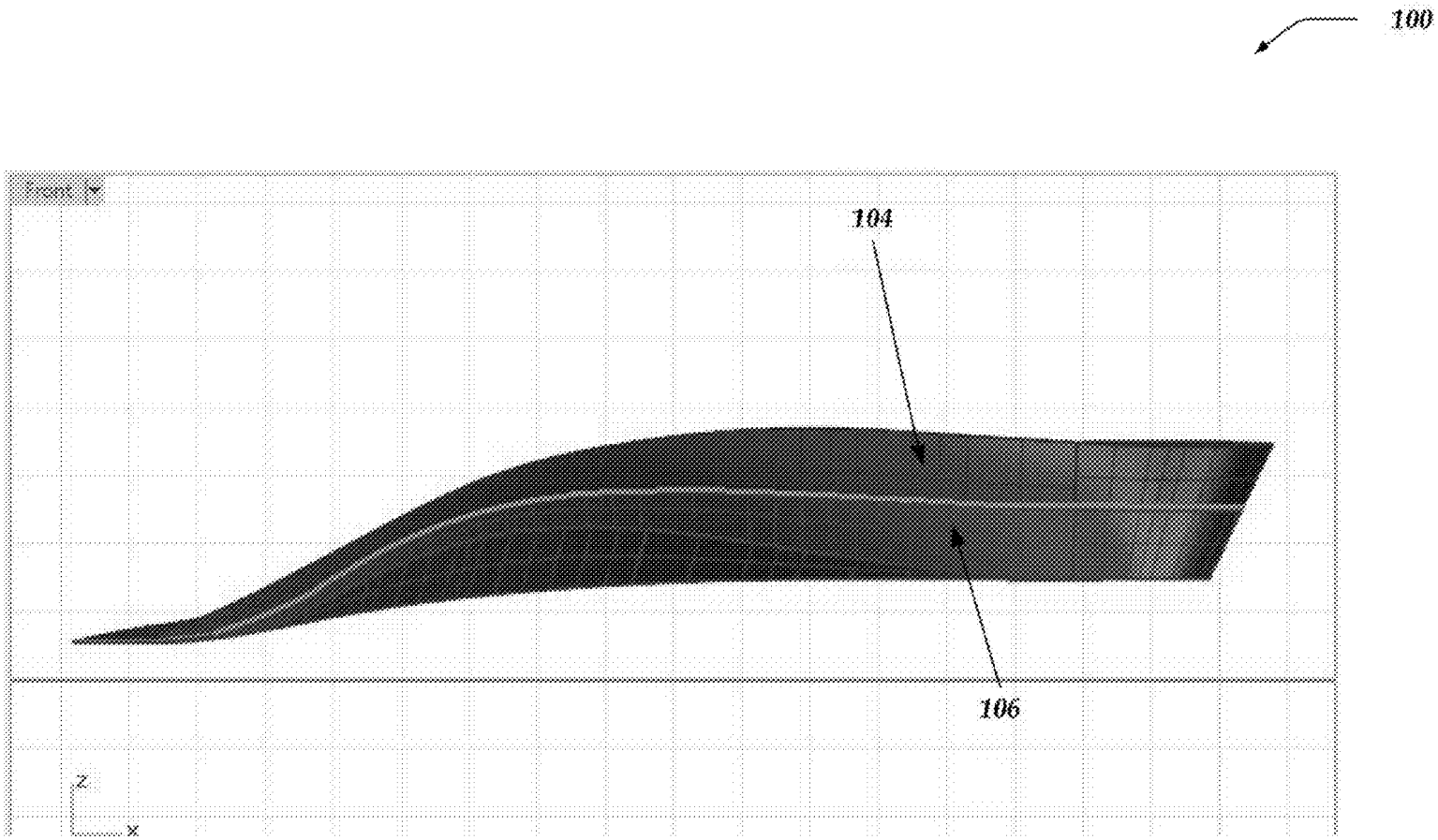
Figure 1L:
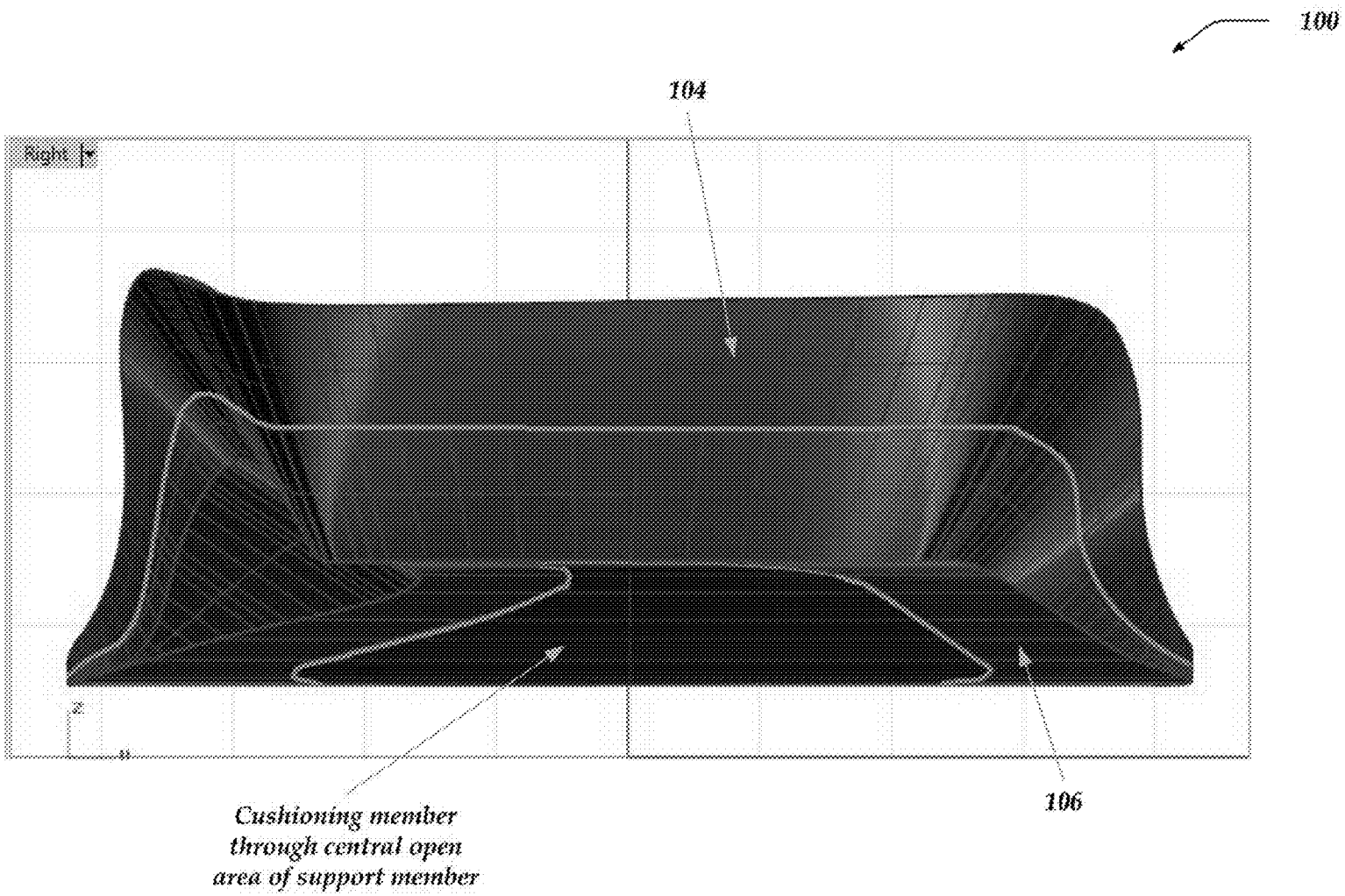
Figure 1M:
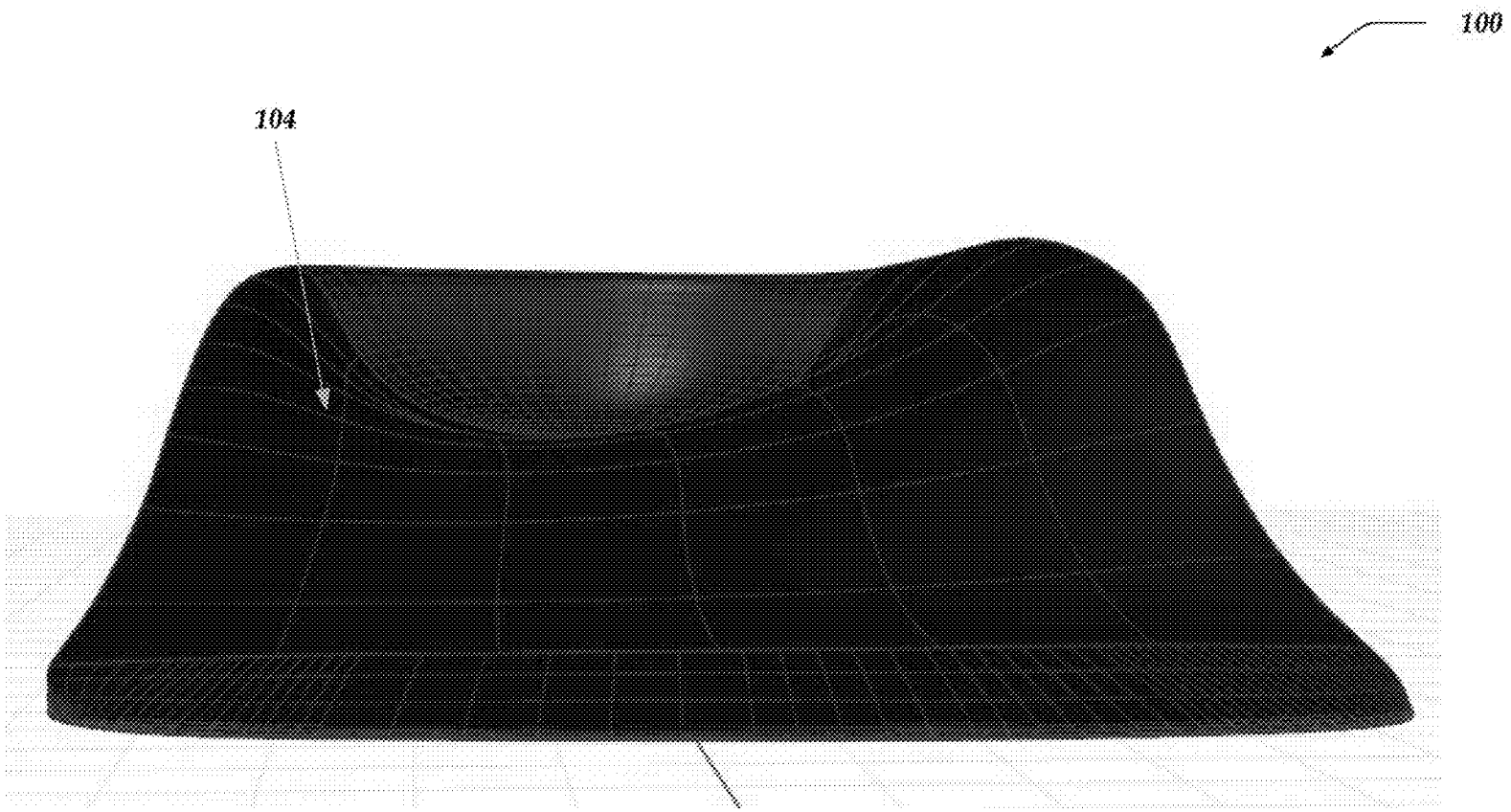

FIGS. 1G-1M illustrate various views of insole 100 with support cushion 104 and support member 106. FIGS. 1G-1M do not show top cover 102 for ease of illustration. FIG. 1G is a top, plan view of the assembled insole 100. FIG. 1H is a top, perspective view of the assembled insole 100. FIG. 1I is a bottom-right, perspective view of the assembled insole 100. FIG. 1J is a bottom-left, perspective view of the assembled insole 100. FIG. 1K is a left side, elevational view of the assembled insole 100. FIG. 1L is a rear, elevational view of the assembled insole 100. FIG. 1M is a front, off-axis elevational view of the assembled insole 100.

As can be seen in the figures, the support member 106 and the cushioning member 104 are sized and contoured to interact with one another, so that the upper, interior surfaces of the support member 106 match and bear against the corresponding surfaces on the lower, exterior of the cushioning member 104. The bottom surface of the cushioning member 104 and the upper surface of the support member 106 may be joined or adhered to one another by any suitable means, including adhesive or thermal bonding, for example. In one non-limiting example, the insole may be formed by a dual molding process where the support member 106 may be molded first and then the cushioning member 104 may be molded directly onto the support member 106, adhering the two together.

As noted above, FIGS. 1A-1M may be for a men's insole and FIGS. 2A-2K may be for a women's insole. Thus, embodiments described in reference to the men's insole also apply to the women's insole. It should be noted that many of the contour differences between the insoles are due to differences in anatomy and biomechanics between men and women. Some of the figures may show slightly different angles and positions of the insoles. For example, in FIGS. 2D and 2E the insole is shown slightly tilted towards the rearfoot portion such that the front-end portion and the rearfoot portion are on the same plane.

Figure 2A:
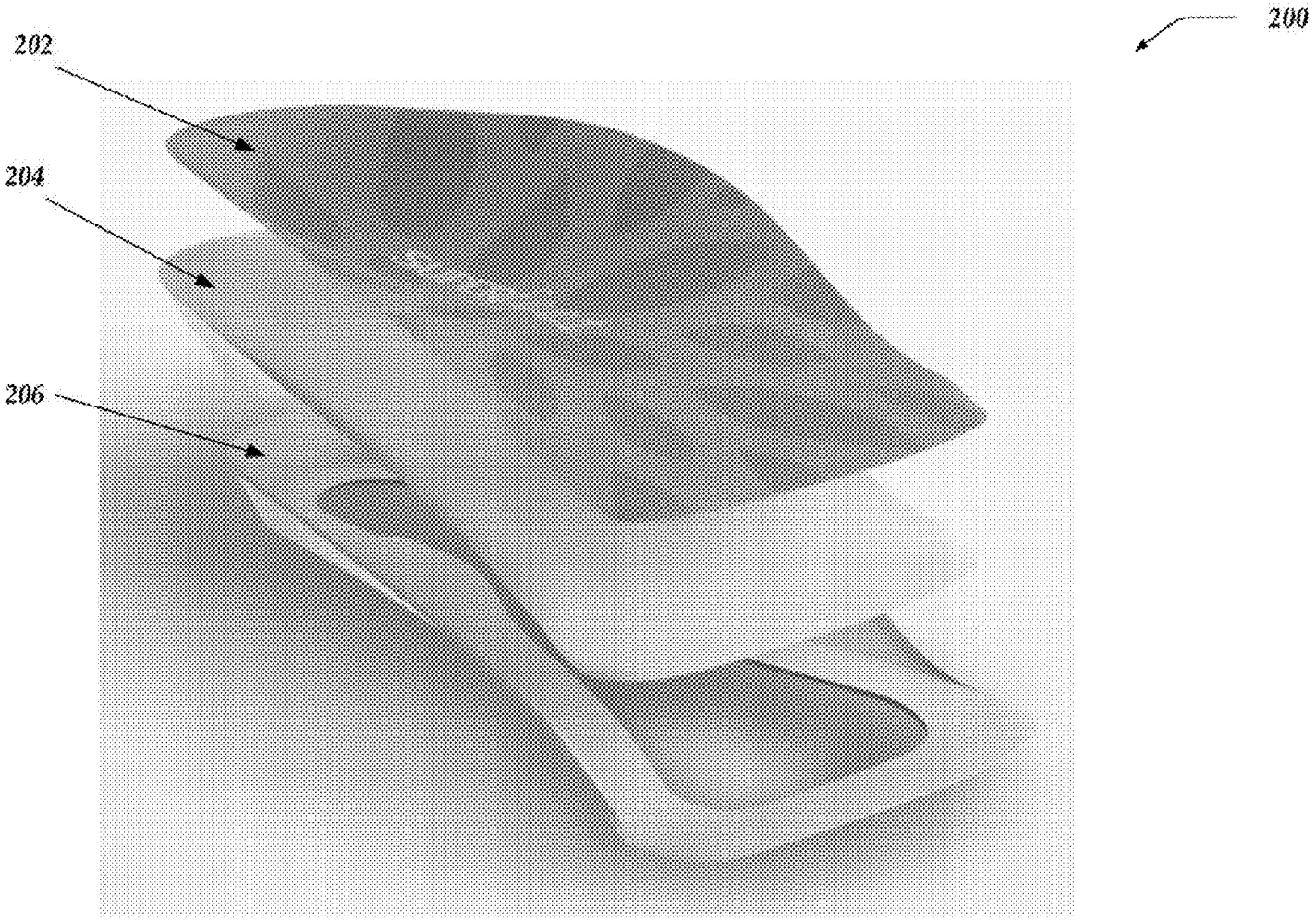
FIGS. 2A-2K illustrate various different views of another three-quarter-length cushioning insole assembly in accordance with embodiments described herein.

FIGS. 2A-2K illustrate various views of a right-foot three-quarter length insole for a female shoe. FIG. 2A is a perspective, exploded view of another cushioning insole 200. As can be seen in FIG. 2A, the components that make up the insole assembly 200 are an upper, cushioning member 204 and a lower, generally rigid support member 206. Cushioning member 204 may be an embodiment of cushioning member 104, but designed for a female foot and shoe. Support member 206 may be an embodiment of support member 106, but designed for a female foot and shoe. Similar to insole 100, insole 200 may also include a top cover 202. The top cover 202 may be an embodiment of top cover 102.

Similar to insole 100, the support member 206 and the cushioning member 204 are sized and contoured to interact with one another, so that the upper, interior surfaces of the support member 206 match and bear against the corresponding surfaces on the lower, exterior of the cushioning member 204.

Figure 2B:
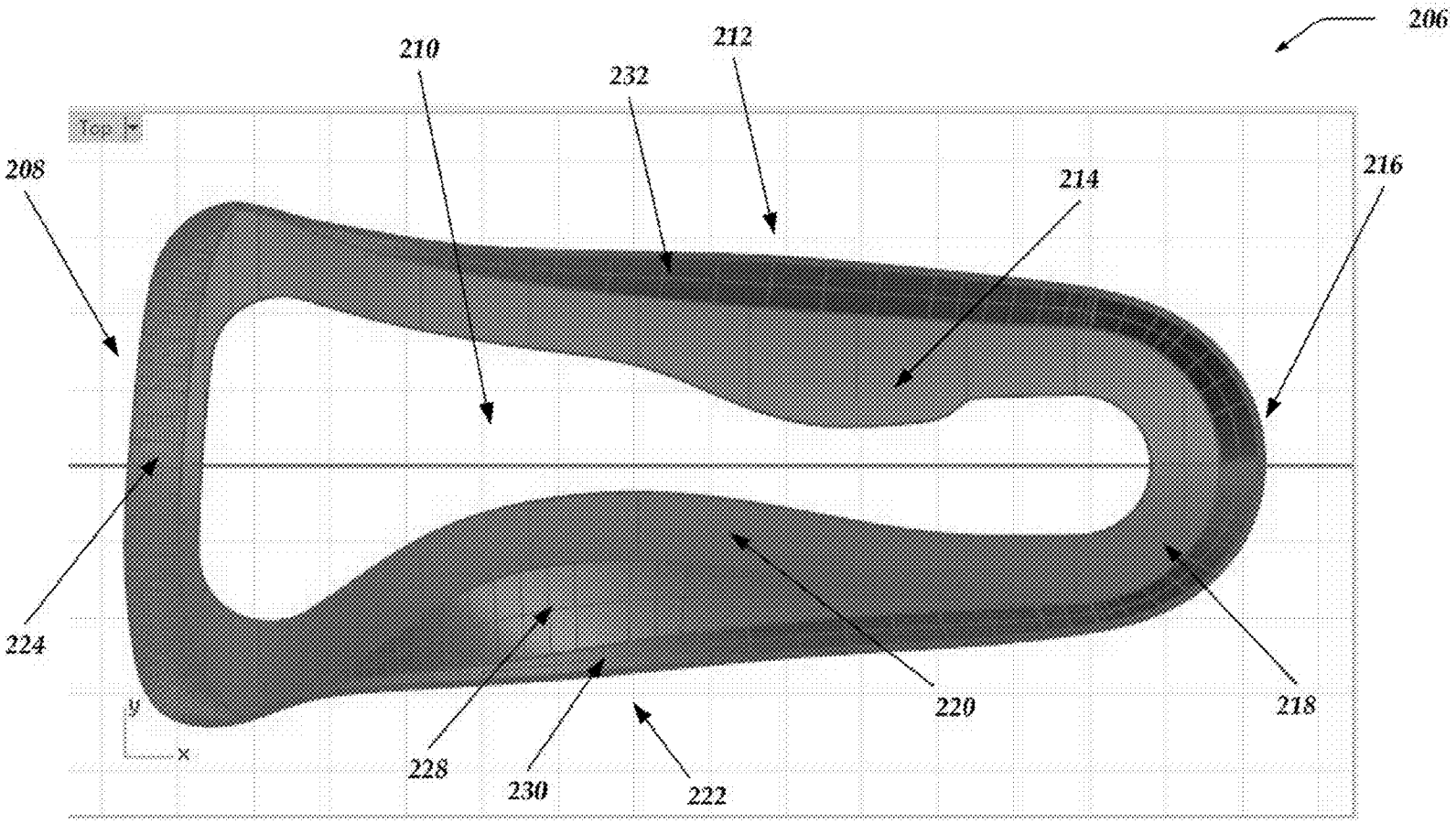
Figure 2C:
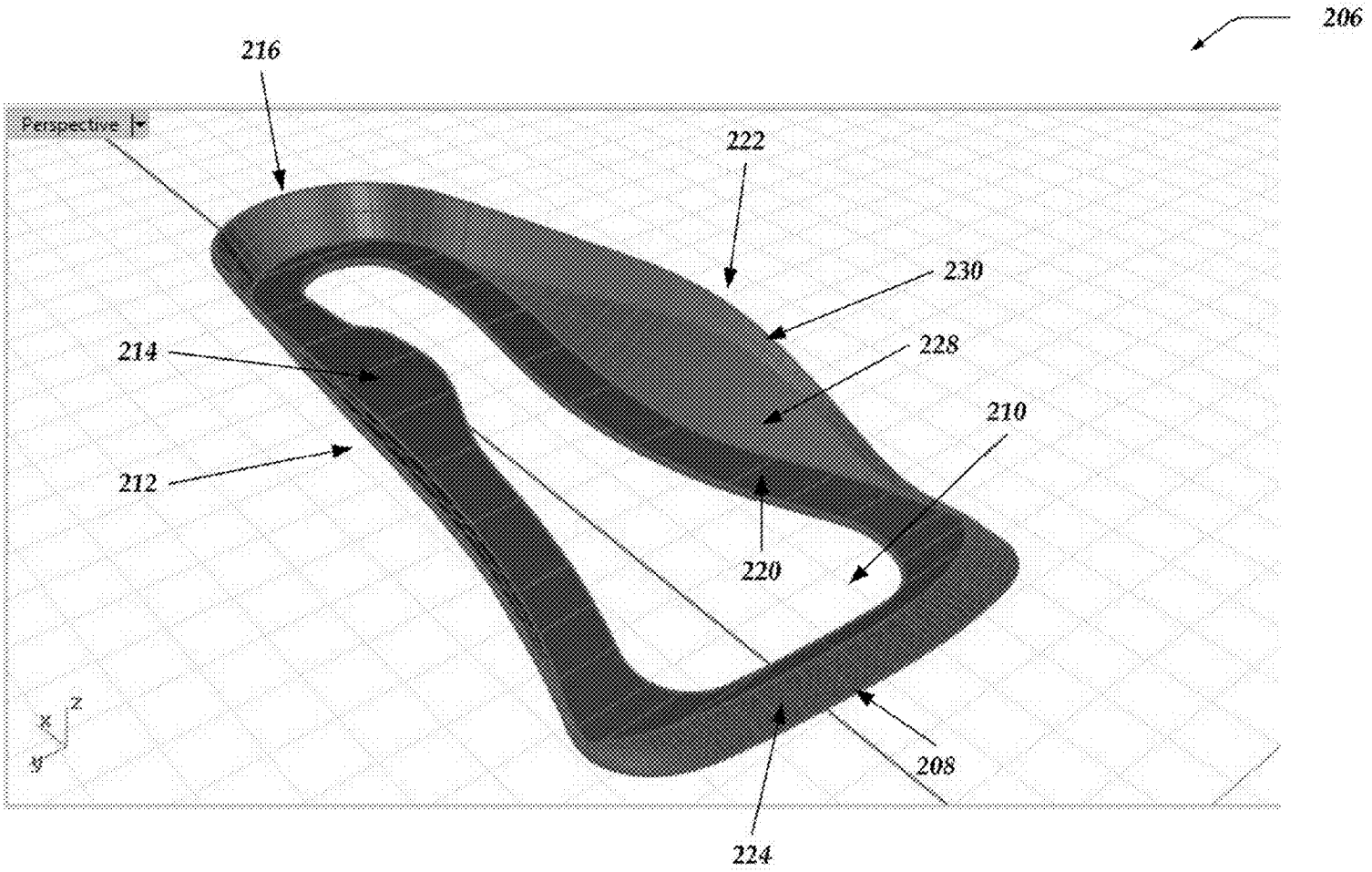
Figure 2D:
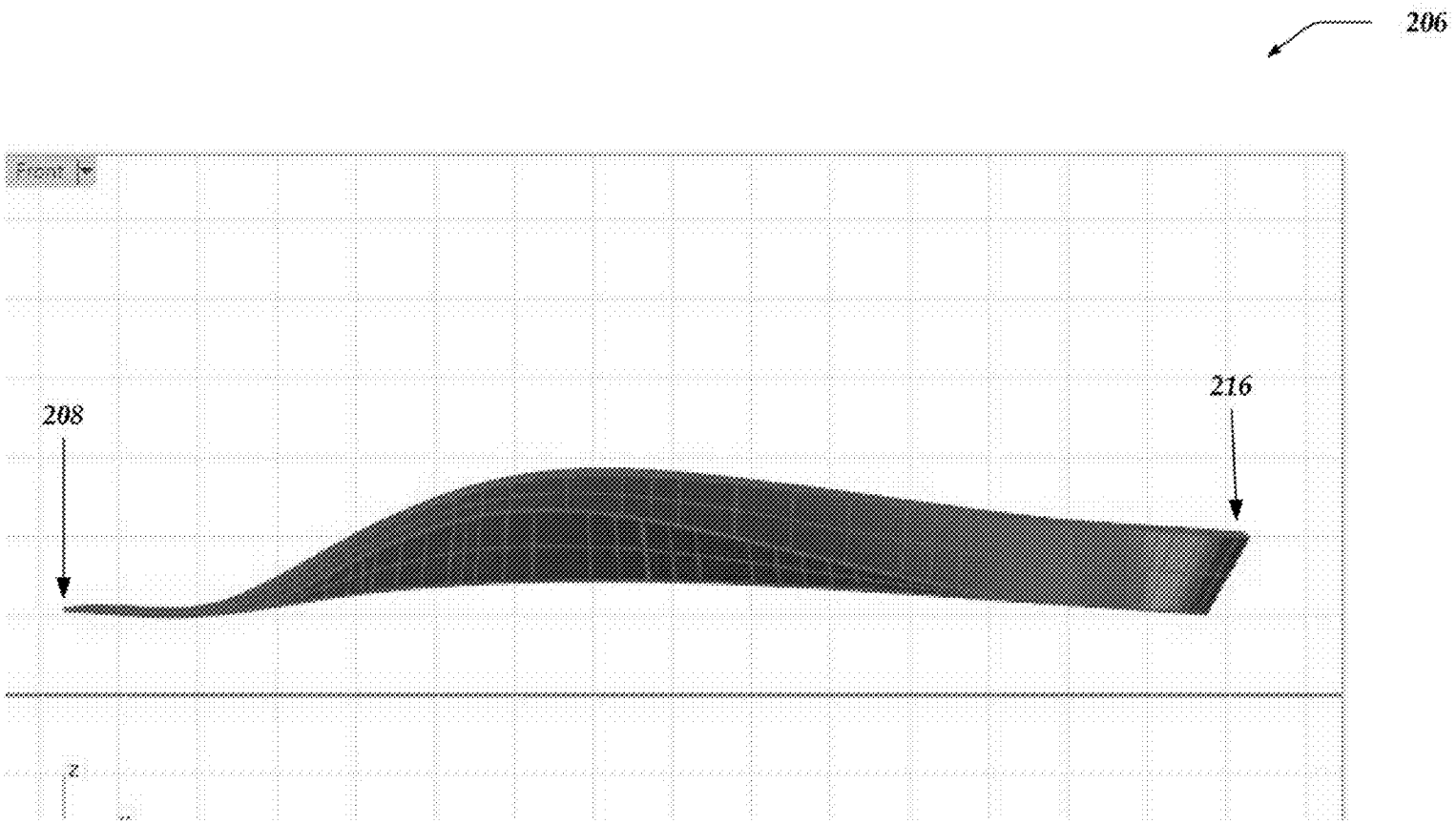
Figure 2E:
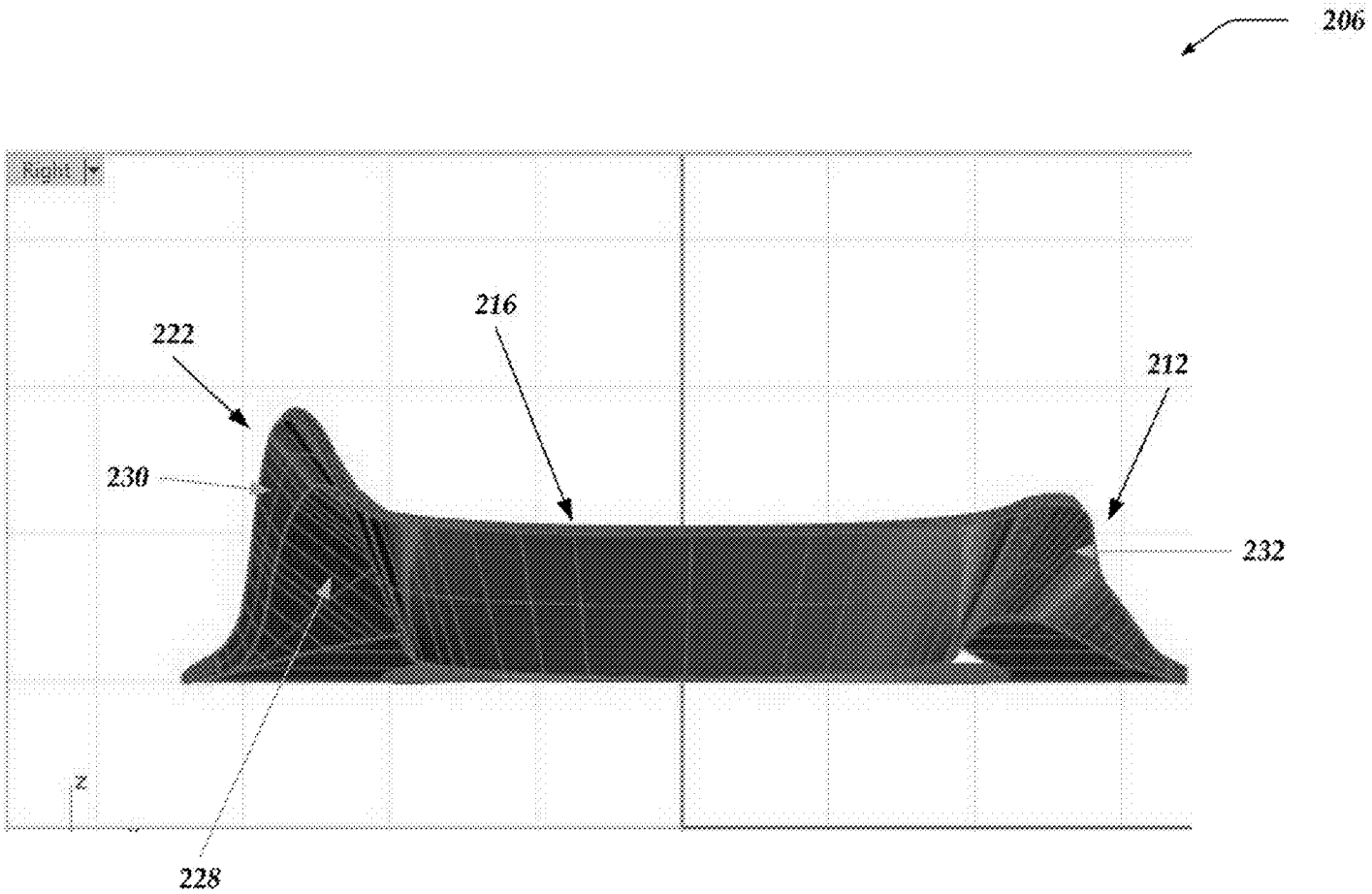
Figure 2F:
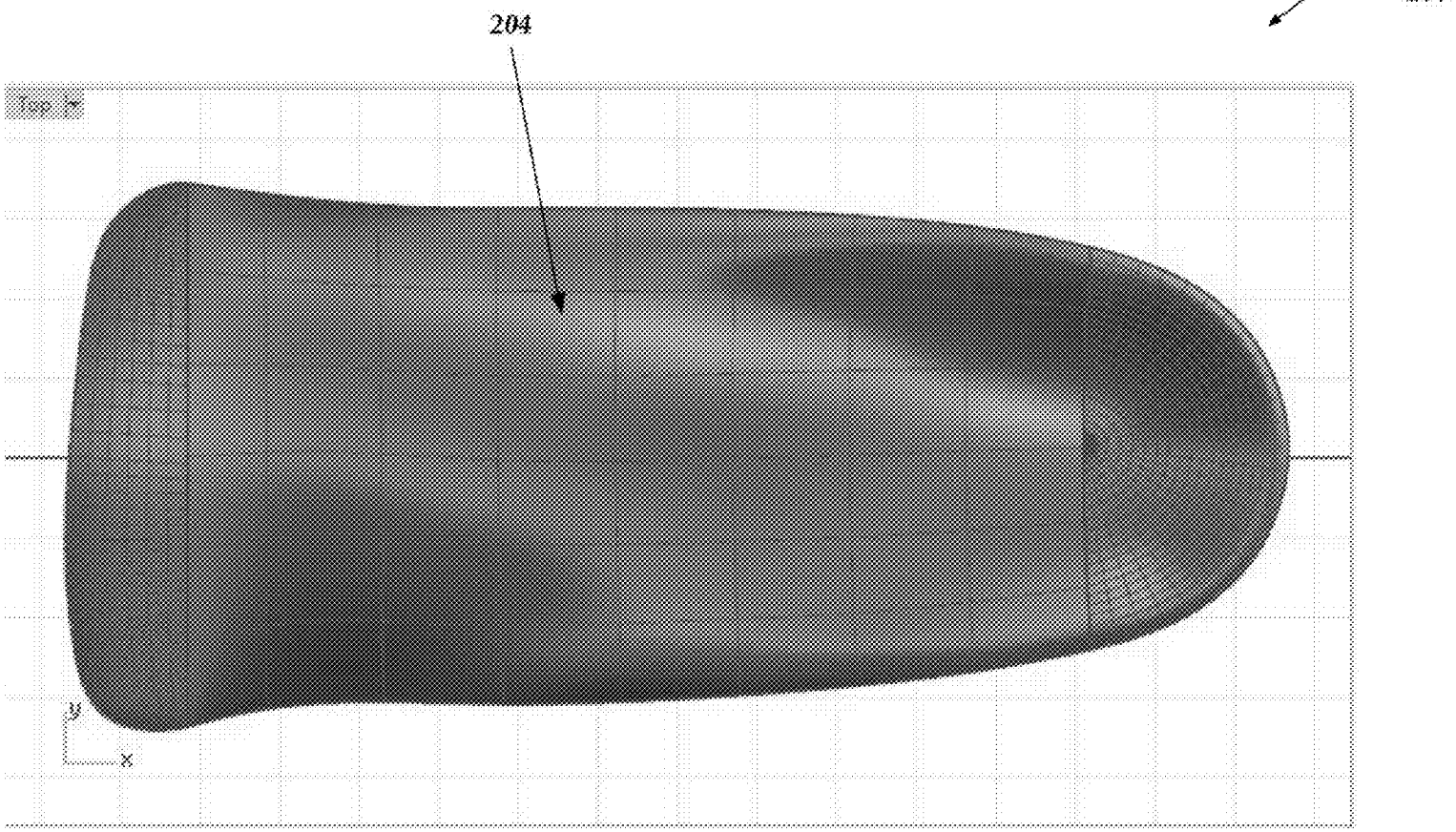
Figure 2G:
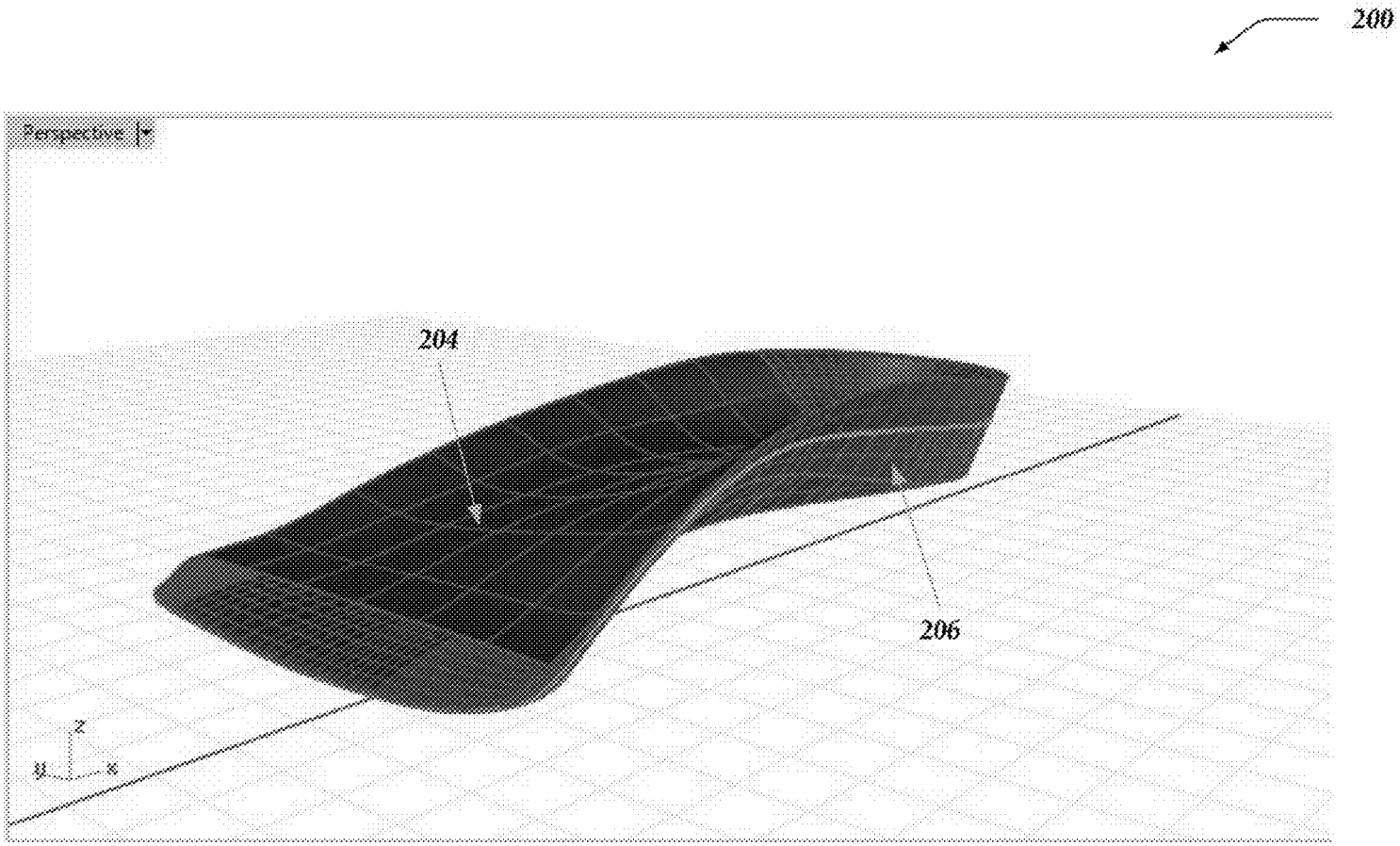
Figure 2H:
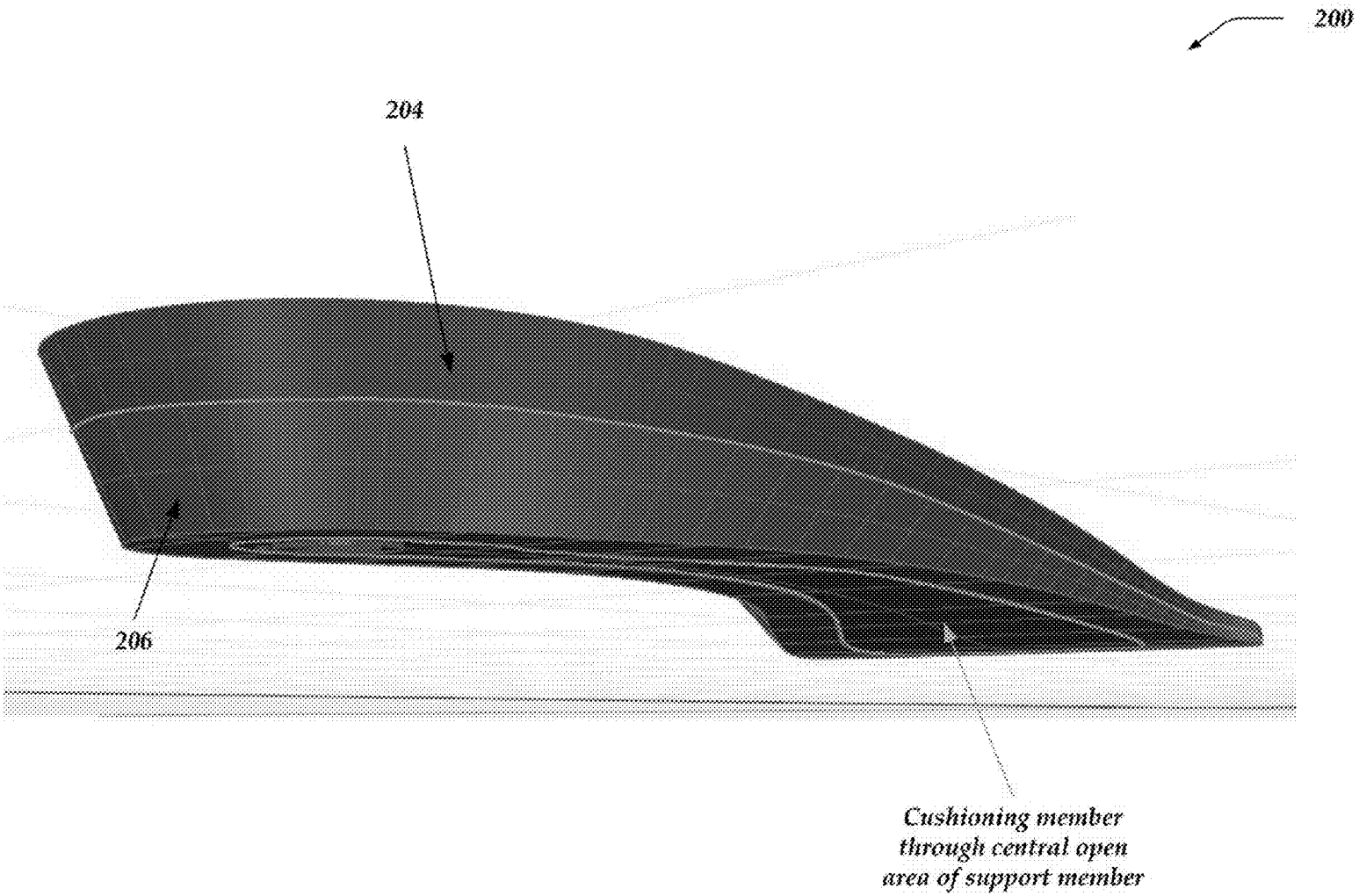
Figure 2I:
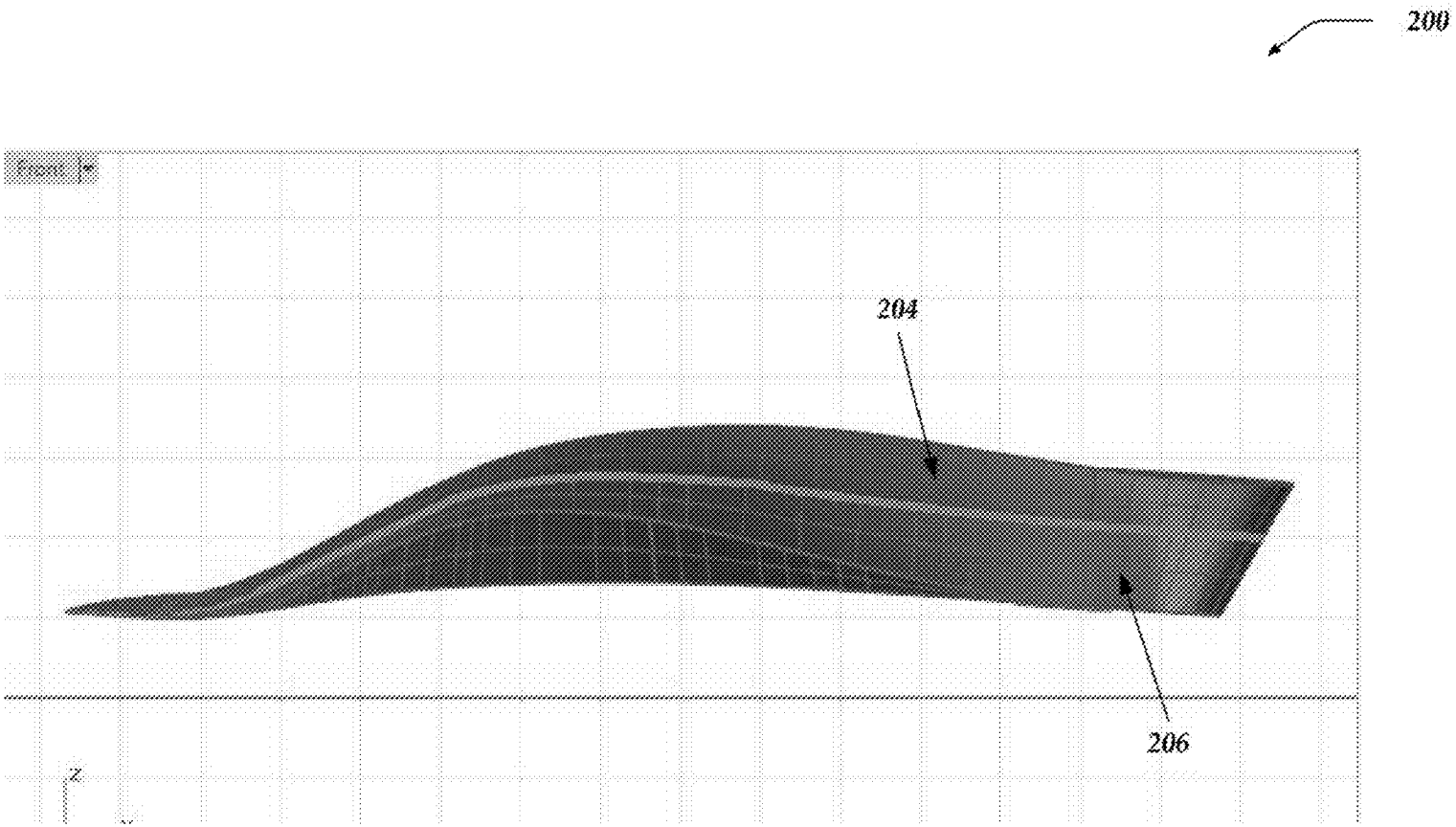
Figure 2J:
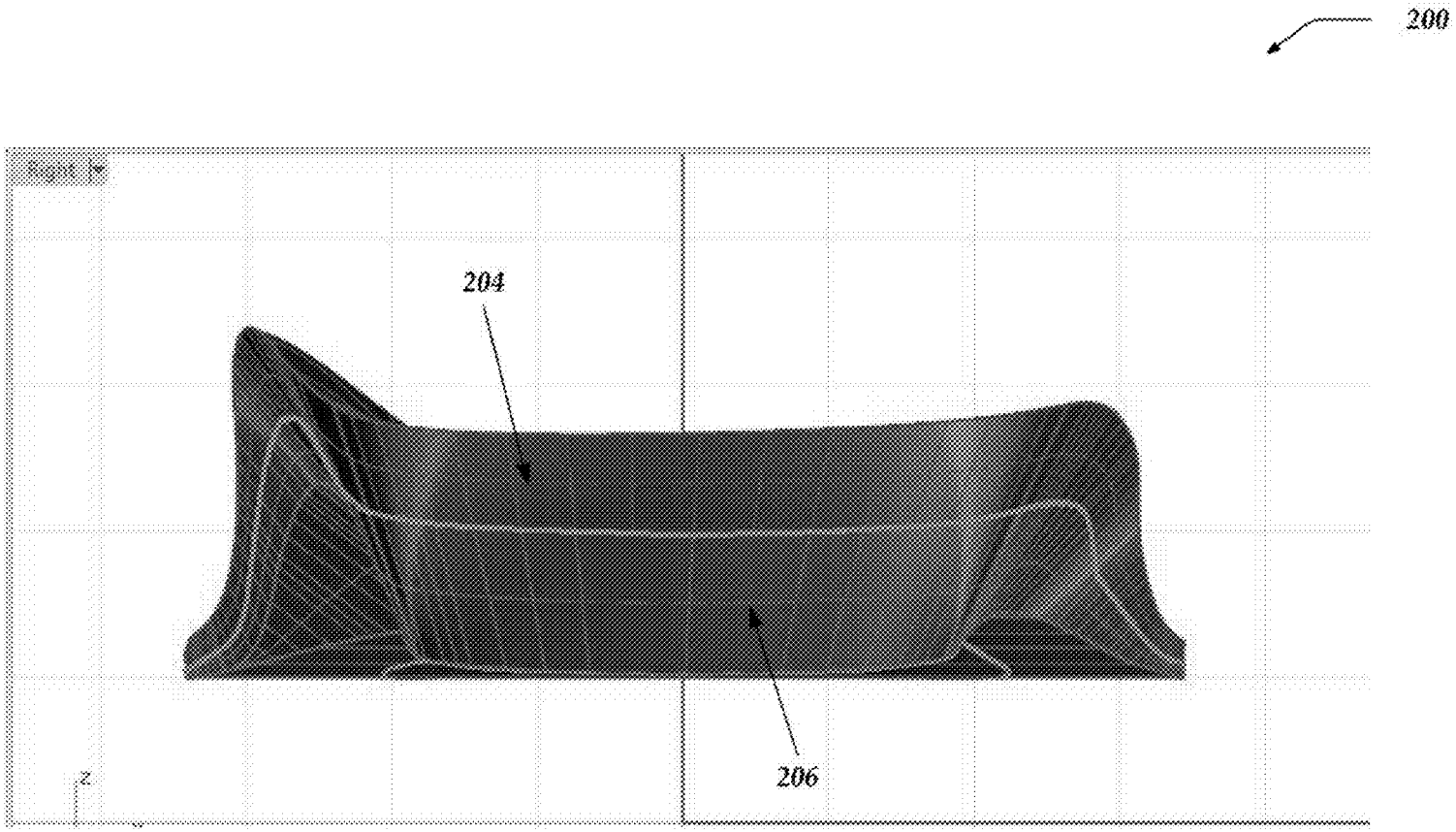
Figure 2K:
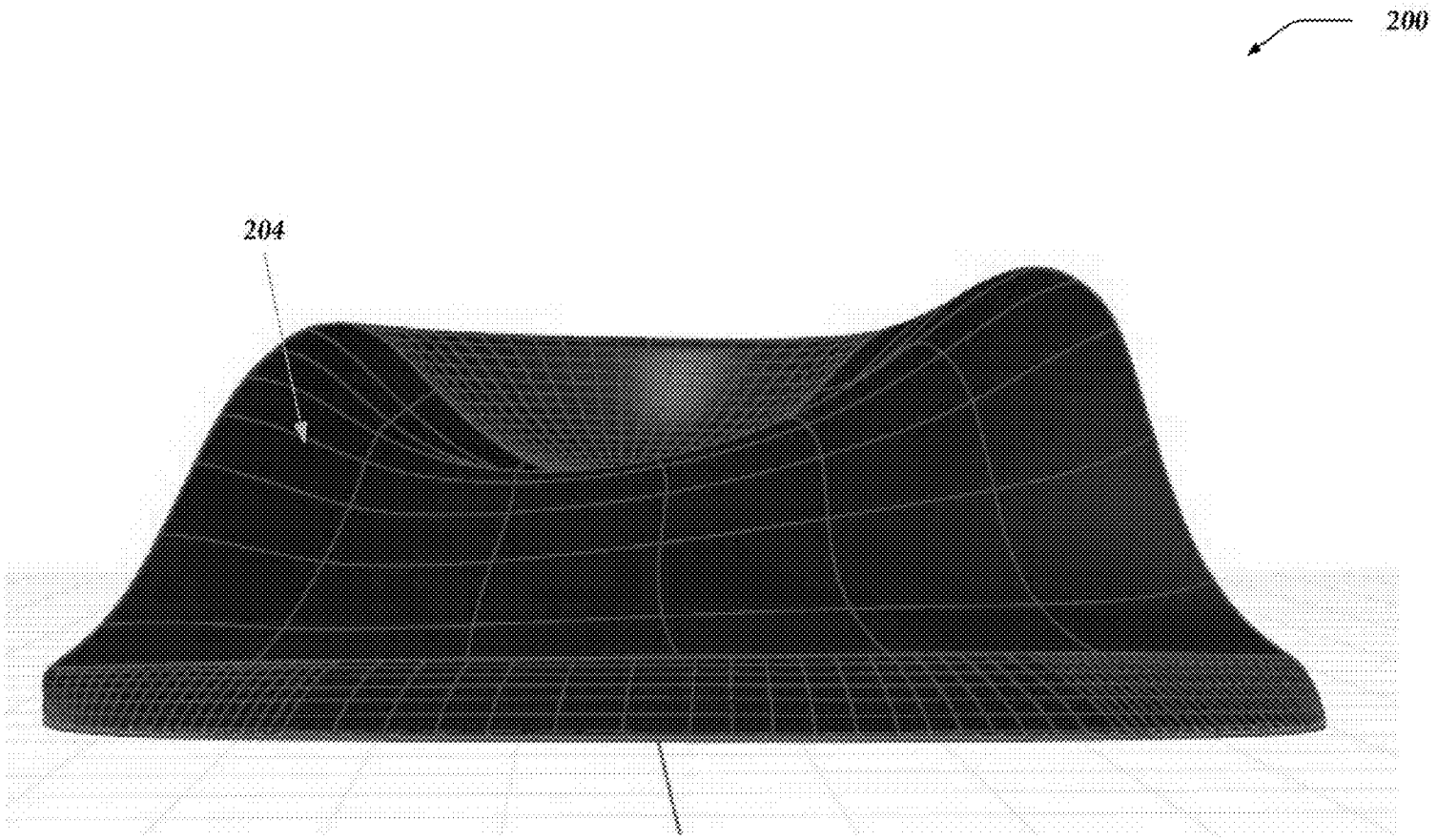

FIG. 2B is a top, plan view of the support member 206 of the insole 200. FIG. 2C is a top, perspective view of the support member 206 of the insole 200. FIG. 2D is a left side, elevational view of the support member 206 of the insole 200. FIG. 2E is a rear, elevational view of the support member 206 of the insole 200. FIG. 2F is a top, plan view of the assembled insole 200 showing the support member 206 and the cushioning member 204. FIG. 2G is a top, perspective view of the insole 200 showing the support member 206 and the cushioning member 204. FIG. 2H is a bottom-right, perspective view of the insole 200 showing the support member 206 and the cushioning member 204. FIG. 2I is a left side, elevational view of the insole 200 showing the support member 206 and the cushioning member 204. FIG. 2J is a rear, elevational view of the insole 200 showing the support member 206 and the cushioning member 204. FIG. 2K is a front, off-axis elevational view of the insole 200 showing the support member 206 and the cushioning member 204.

In various embodiments, the support member 206 includes medial and lateral upstanding walls (medial wall 230 and lateral wall 232) that extend along the medial side 222 and lateral side 212 of the cushioning member 204 and around the cushioning member's rearfoot end at rearfoot end 216. First flange portion (medial flange portion 220) and second flange portions (lateral flange portion 214) extend inwardly from the bottom edges of the side wall portions (medial wall 230 and lateral wall 232), respectively, and are connected at the rear by a rearfoot flange 218 and at the front by a front-end (midfoot) flange 224 at front end 208 to create central open area 210.

The medial side 222 of support member 206 also includes an arch transition portion 228 that is between the medial side wall 230 and the medial flange 220 such that the arch transition portion 228 slopes downwardly from the medial side wall 230 at the outside of the support member 206 to the medial flange portion 220 at the bottom (adjacent to the top of the sole of the wearer's shoe) of the support member 206. In various embodiments, the arch transition portion 228 may be concave along the wearer's arch from a front position 234 to a rear position 236 on the medial side 222.

In various embodiments illustrated in FIGS. 2A-2K, front end 208, central open area 210, lateral flange portion 214, rearfoot end 216, rearfoot flange 218, medial flange portion 220, front-end flange 224, arch transition portion 228, medial wall 230, and lateral wall 232 of support member 206 may be embodiments of front end 108, central open area 110, lateral flange portion 114, rearfoot end 116, rearfoot flange 118, medial flange portion 120, front-end flange 124, arch transition portion 128, medial wall 130, and lateral wall 132 of support member 106, respectively.

Figure 3A:
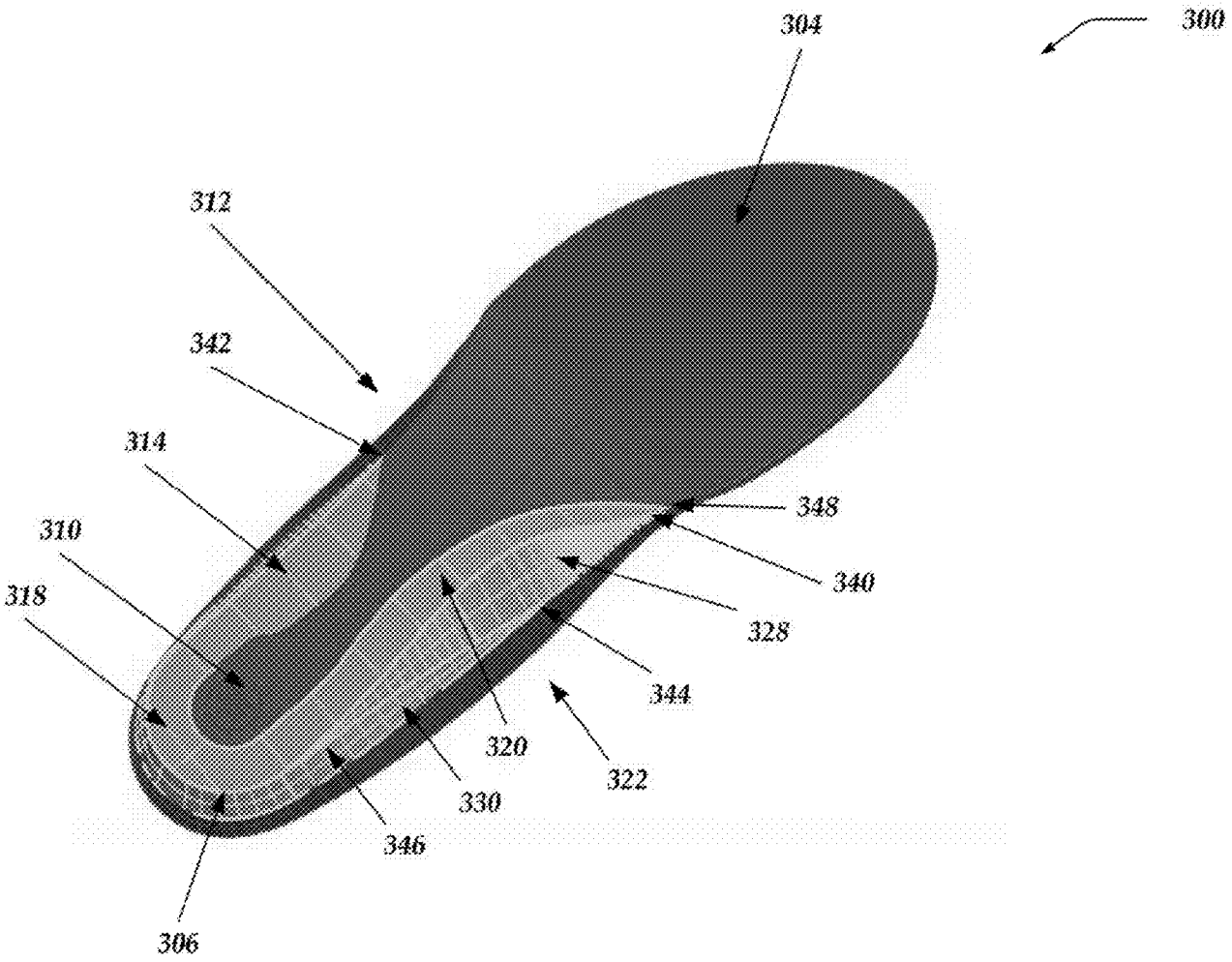
FIGS. 3A-3G illustrate various different views of a full-length cushioning insole assembly in accordance with embodiments described herein.
Figure 3B:
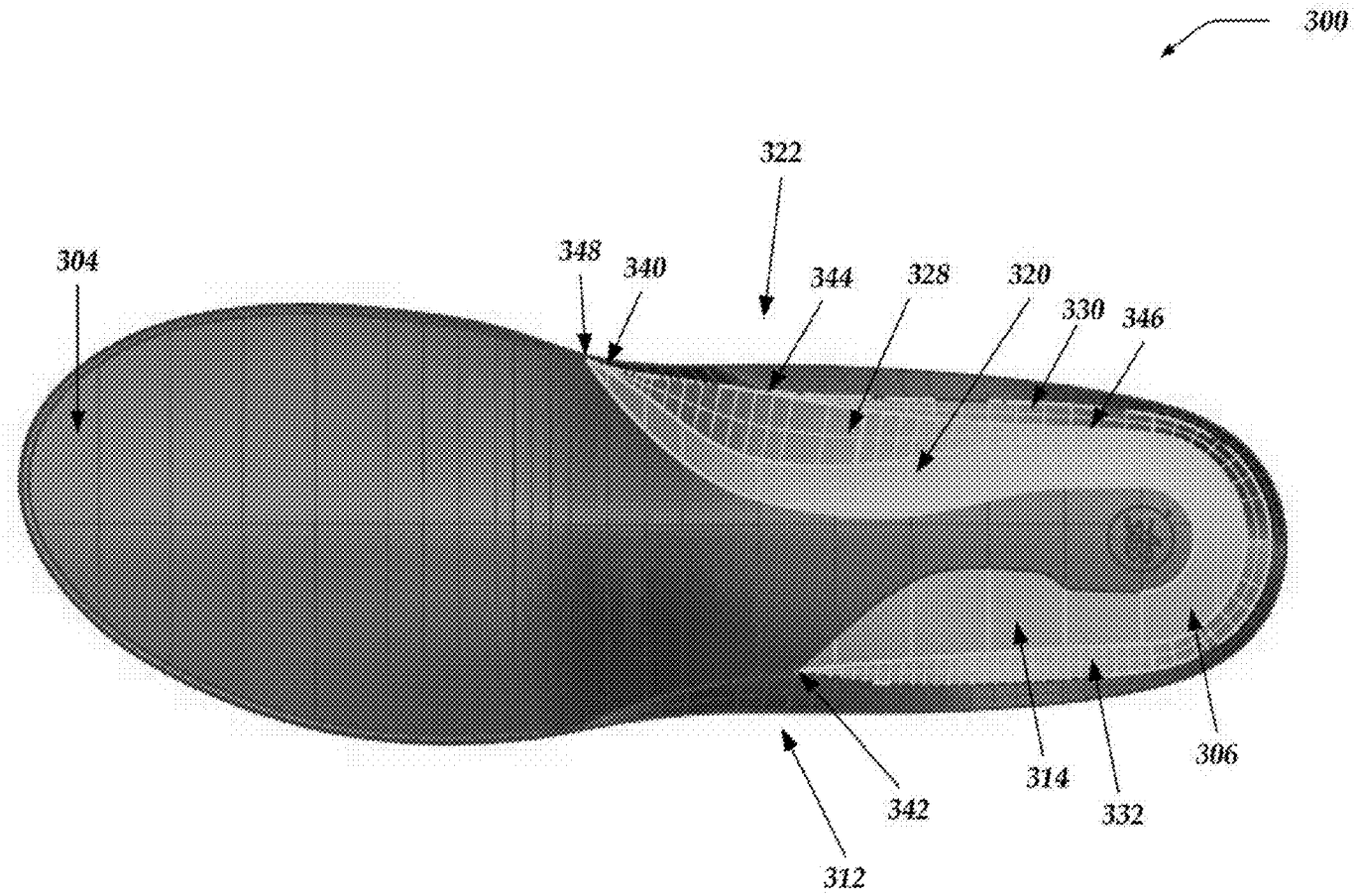
Figure 3C:
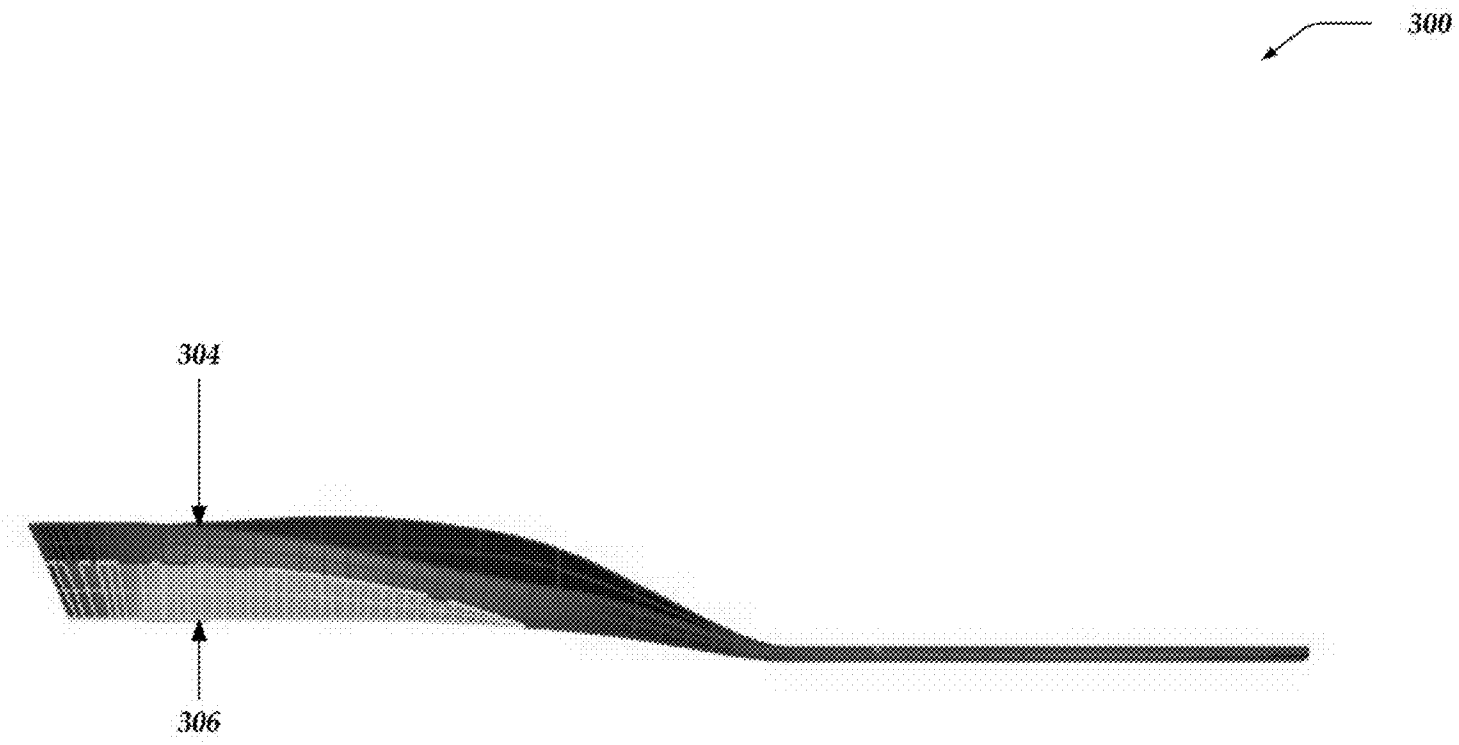
Figure 3D:
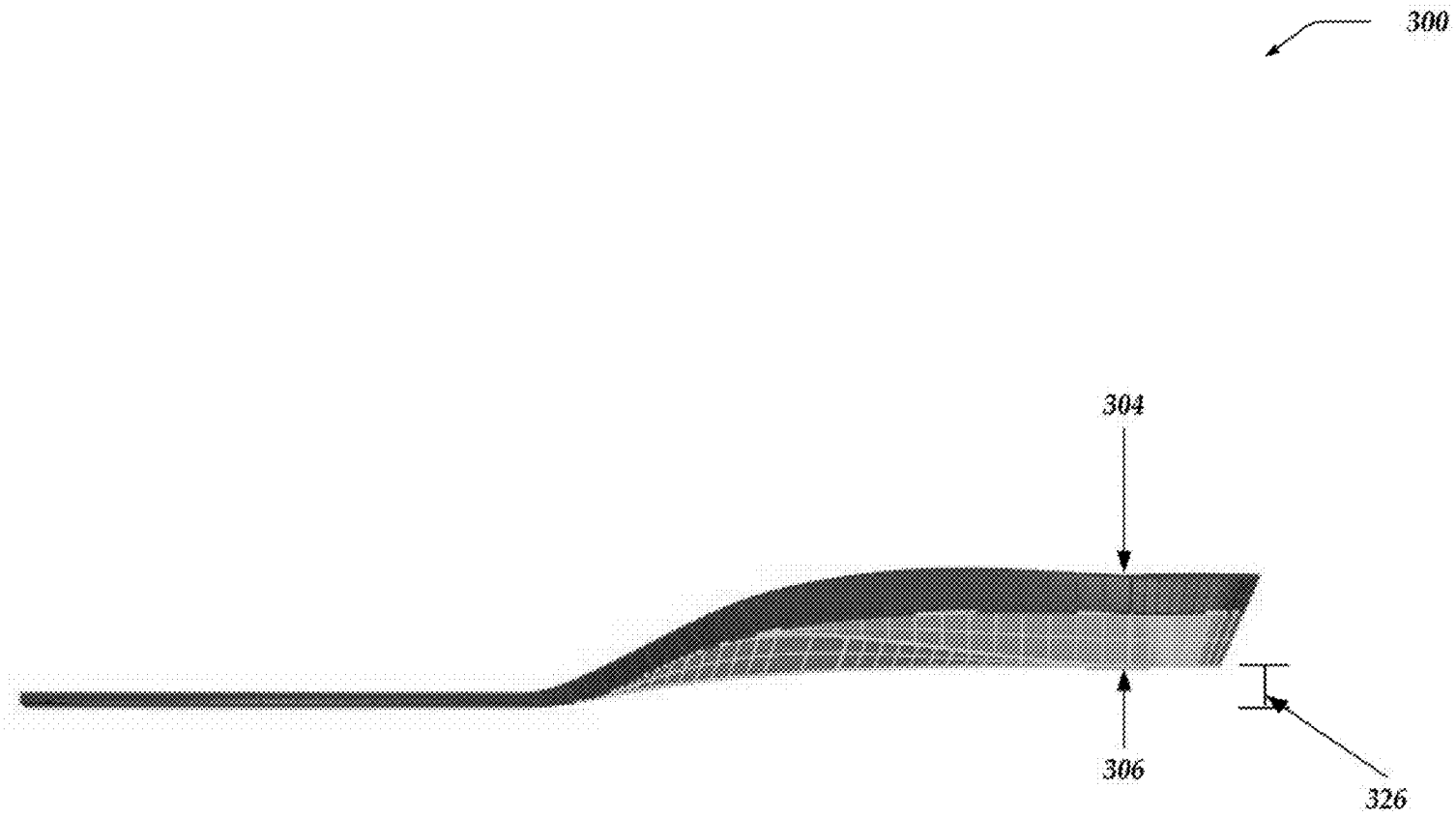
Figure 3E:
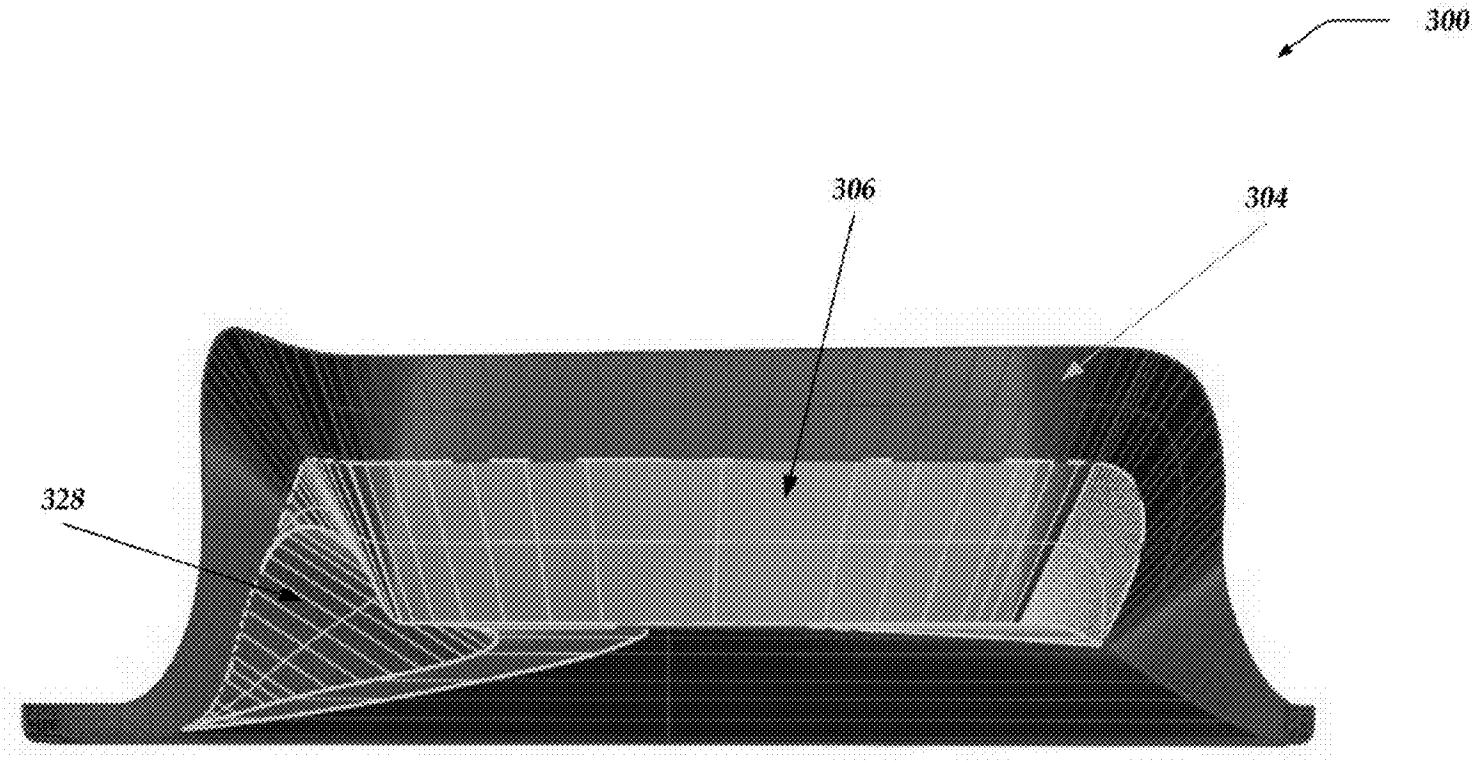
Figure 3F:
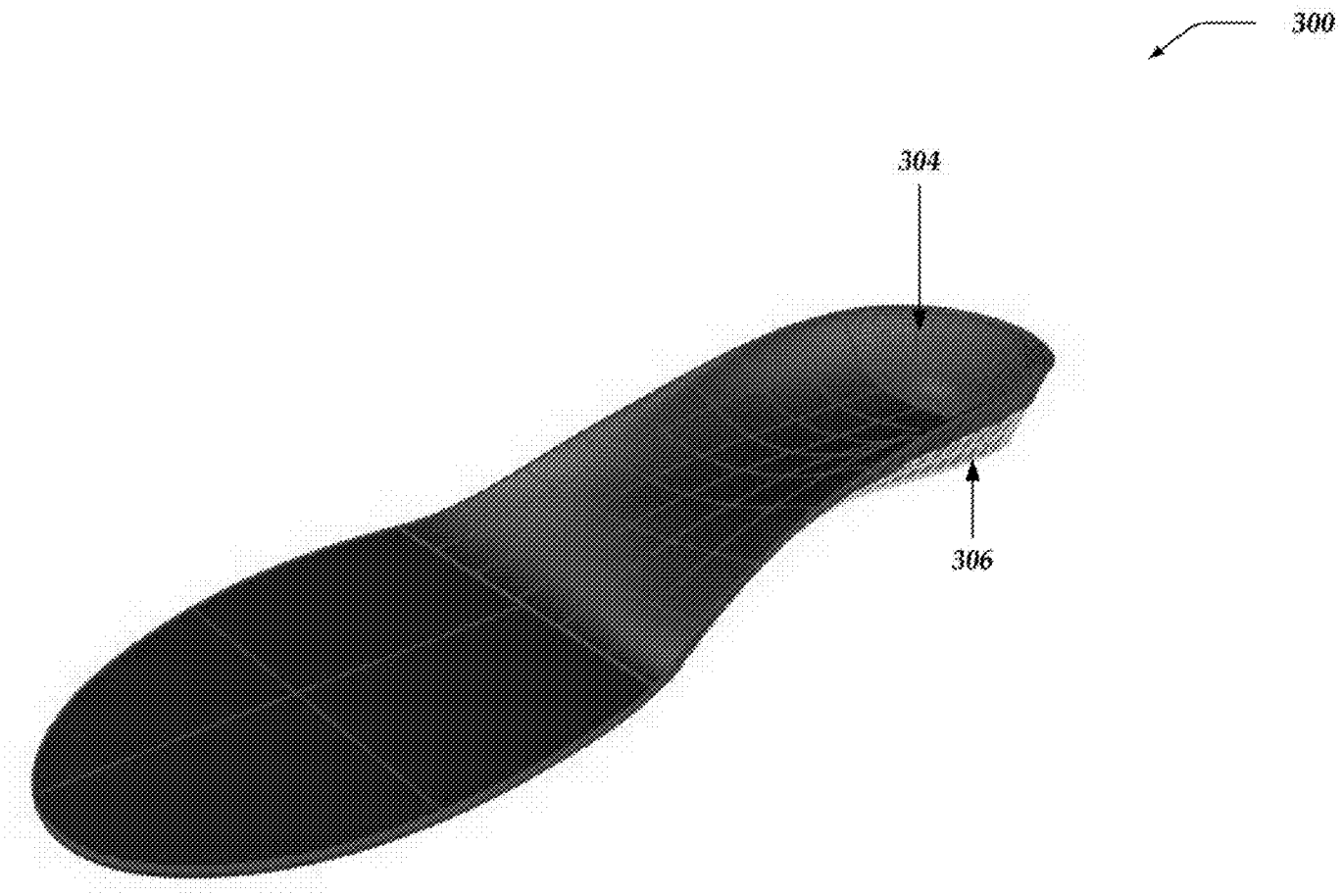
Figure 3G:
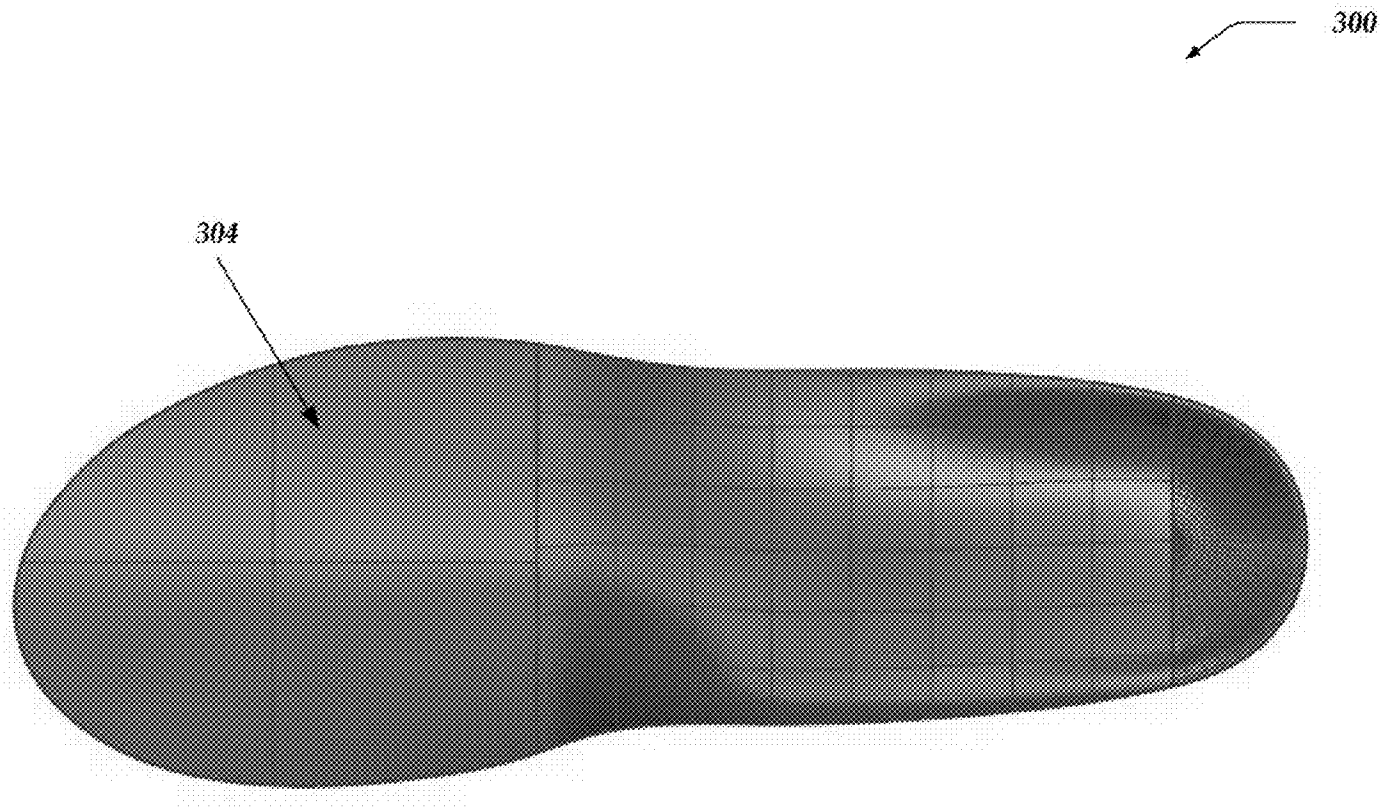

Insoles 100 and 200 described above are three-quarter-length insoles. FIGS. 3A-3G illustrate various views of a full-length insole. FIG. 3A is a bottom-right, perspective view of a cushioning insole assembly 300. FIG. 3B is a bottom, plan view of the insole 300. FIG. 3C is a right side, elevational view of the insole 300. FIG. 3D is a left side, elevational view of the insole 300. FIG. 3E is a rear, elevational view of the insole 300. FIG. 3F is a top, perspective view of the insole 300. FIG. 3G is a top, plan view of the insole 300.

Insole 300 includes a cushioning foam member 304 and a semi-rigid support member 306. In some embodiments, the insole 300 may also include a top cover (similar to that illustrated in previous embodiments). This top cover may be a fabric material that can aid in comfort of the insole, sweat or odor control, or the like.

The body of the cushioning member 304 is formed of a cushioning material. The cushioning member 304 will generally extend from a rear of an underlying shoe sole to a front of the underlying shoe. In some embodiments, this length may be referred to as a full-length of the underlying shoe sole. The upper surface of the cushioning member 304 is contoured to engage and cradle the plantar surface of a person's foot. The bottom surface of the cushioning member 304 is generally flat but with similar planar contours as the top surface of the support member 306 so that the cushioning member 304 along with the support member 306 match and rest on top of a standard shoe sole in a stable manner. A thin, substantially flat midfoot portion of the cushioning member 304 extends generally in the transverse plane at the front of the member, while the rearward end includes a downwardly concave heel cup portion to engage the heel of a wearer's foot.

The rigid support member 306, in turn, is configured and arranged to cooperate with the cushioning member 304, which is described in more detail below. In general, the support member 306 in conjunction with the cushioning member 304 maintains the shape of the insole 300 without relying on inward buttressing from the shoe, and also to provide optimized support for different parts of the foot.

As can be seen in FIGS. 3A-3G, the support member 306 is a comparatively thin, bifurcated, component—similar to support member 106 or 206 described above—that extends partially along the perimeter of the cushioning member 304 such that it extends around the rearfoot end of the cushioning member 304, forwardly along the medial and lateral sides thereof, which provides support along the perimeter of the cushioning member 304. The support member 306 may be made of nylon plastic, but other injection molded plastics may also be utilized to provide more or less rigidity depending on engineering judgment. The materials utilized for the support member 306 may be determined based on their characteristics for being relatively light in weight yet possesses sufficient strength and rigidity.

The support member 306 itself includes medial and lateral upstanding walls (medial wall 330 and lateral wall 332) that extend along the medial and lateral sides of the cushioning member 304 and around the cushioning member's rearfoot end at the rearfoot end. First flange portion (medial flange portion 320) and second flange portions (lateral flange portion 314) extend inwardly from the bottom edges of the sidewall portions (medial wall 330 and lateral wall 332), respectively, and are connected at the rear by a rearfoot flange 318.

The medial flange portion 320 terminates forward of the arch transition portion 328 at position 348. The lateral flange portion 314 terminates mid-arch on the lateral side 312 at position 342 such that position 342 is rearward of position 348.

The rearfoot flange 318 may be generally U-shaped such that it extends around the heel end of the device so as to partially surround the heel cup portion of the cushioning member 304. The rearfoot flange 318 extends into medial flange portion 320 on one side of the support member 306 and lateral flange 314 on the other side.

The arch side (or medial side 322) includes an arch transition portion 328 between the medial side wall 330 and the medial flange 320 such that the arch transition portion 328 slopes downwardly from the medial side wall 330 at the outside of the support member 306 to the medial flange portion 320 at the bottom (adjacent to the top of the sole of the wearer's shoe) of the support member 306. In some embodiments, the forward portion of the medial sidewall 330 may terminate at position 344 that is mid-arch and rearward of position 340 of the arch transition portion 328.

In various embodiments, the underside of the arch transition portion 328 may be concave along the wearer's arch from a front position 340 to a rear position 346 on the medial side 322. In some embodiments, front position 340 may be rearward of position 348 and the front of medial flange portion 320, and rear position 346 may be forward of rearfoot flange 318. This arch transition, along with the central open area 310 enable the insole 300 to flex laterally to more easily fit into narrower or internally contoured shoes (i.e., shoes with an internal width at the arch that is narrower than the width at the arch of the insole), while also providing sufficient support for a wearer's foot in wider shoes (i.e., shoes with an internal width at the arch that is wider than the width at the arch of the insole). The contour of the arch transition portion 328 also allows the insole to nest in a position of stability within shoe uppers that may have a sloping contour.

The medial flange 320, lateral flange 314, and rearfoot flange 318 may be a relatively uniform width along the shoe sole. The medial flange 320 and the lateral flange 114 may be arcuate and converge towards longitudinal centerline of the insole to create an hourglass-like shape, but that the medial flange 320 and the lateral flange 314 remain separated by a central open area 310. In some embodiments, the medial flange 320 may have a more pronounced arcuate shape than the lateral flange 314. This hourglass-shaped medial and lateral sides can make the insole compatible with a larger variety of shoes than an insole with medial and lateral sides that are relatively parallel. This is especially beneficial for enabling the insole to be used in narrower and/or internally contoured shoes.

In some embodiments, the lateral flange portion 314 may include an extended flange portion to further engage the bottom surface of the cushioning member 304. This extended flange portion generally has arcuate inner edges that converge towards the longitudinal centerline of the assembly, but still remain separated from the medial flange 320 by the central open area 310. In this way, the cushioning member 304 can engage a sole of the shoe through the central open area 310.

In some embodiments, the insole 300 and/or support member 306 may slightly curve downward from the rearfoot portion to the front-end portion, as can be seen in FIG. 3D. This slight curvature can create an elevated heel portion 326, which acts like a spring when a wearer applies weight to the insole. Or it may simply more closely follow the internal contours of the footwear midsole or sole.

The above specification, examples, and data provide a complete description of the manufacture and use of the composition of the invention. Since many embodiments of the invention can be made without departing from the spirit and scope of the invention, the invention resides in the claims hereinafter appended.

What is claimed is:

1. An insole assembly for an article of footwear, comprising:

a substantially soft, resiliently compressible cushioning member having an upper surface for engaging a plantar surface of a foot and a bottom surface; and a substantially rigid, resiliently flexible support member engaged with a portion of the bottom surface of the cushioning member, the support member having a rearfoot portion that extends around a heel end of the cushioning member, medial and lateral side portions that extend forwardly from the rearfoot portion on opposite sides of a central opening in the support member, the medial side portion includes an arch transition portion that downwardly slopes from an outside of the insole to a medial flange portion under the bottom surface of the cushioning member.

2. The insole of claim 1, wherein the support member includes a front-end portion connecting the medial and lateral side portions and configured to be near a midfoot region of the footwear.

3. The insole of claim 1, wherein the support member includes a front-end portion connecting the medial and lateral side portions such that the support member extends along an entire perimeter of the cushioning member.

4. The insole of claim 1, wherein the support member includes a front-end portion connecting the medial and lateral side portions, the front-end portion tapering toward a front of the insole.

5. The insole of claim 1, wherein the support member includes a front-end portion connecting the medial and lateral side portions, a front of the front-end portion abutting a front of the cushioning member and configured to be near a midfoot of the footwear.

6. The insole of claim 1, wherein the arch transition portion slopes downwardly from a medial wall on an outside of the insole to the medial flange portion under the bottom surface of the cushioning member.

7. The insole of claim 1, wherein the arch transition portion is generally concave and configured to extend along a wearer's arch.

8. An insole assembly for an article of footwear, comprising:

a substantially soft, resiliently compressible cushioning member having an upper surface for engaging a plantar surface of a foot and a bottom surface; and a substantially rigid, resiliently flexible support member engaged with a portion of the bottom surface of the cushioning member, the support member having a rearfoot portion that extends around a heel end of the cushioning member, medial and lateral side portions that extend forwardly from the rearfoot portion on opposite sides of a central opening in the support member to a front-end portion that is near a midfoot region of the footwear creating the central opening, wherein the support member extends along an entire perimeter of the cushioning member.

9. The insole of claim 8, wherein the support member wherein the support member includes a front-end portion connecting the medial and lateral side portions, a front of the front-end portion abutting a front of the cushioning member and configured to be near a midfoot of the footwear.

10. The insole of claim 8, wherein the front-end portion includes a front-end flange that tapers toward a front of the insole.

11. The insole of claim 8, wherein support member includes an arch transition portion that slopes downwardly from a medial wall on an outside of the insole to a medial flange portion under the bottom surface of the cushioning member.

12. The insole of claim 8, wherein support member includes an arch transition portion that is generally concave and configured to extend along a wearer's arch.

13. The insole of claim 8, wherein a front of the support member is connected to a front of the cushioning member and configured near a midfoot of the footwear.

14. An insole assembly for an article of footwear, comprising:

a substantially soft, resiliently compressible full-length cushioning member having an upper surface for engaging a plantar surface of a foot and a bottom surface; and a substantially rigid, resiliently flexible support member engaged with a portion of the bottom surface of the cushioning member, the support member having a rearfoot portion that extends around a heel end of the cushioning member, medial and lateral side portions that extend forwardly from the rearfoot portion on opposite sides of a central opening in the support member, the medial side portion includes an arch transition portion that slopes downwardly from an outside of the insole to a medial flange portion under the bottom surface of the cushioning member.

15. The insole of claim 14, wherein a forward position of the lateral side portion ends mid arch.

16. The insole of claim 14, wherein a front position of a medial wall ends mid arch into the arch transition portion.

17. The insole of claim 14, wherein a forward position of the arch transition portion ends rearward of a forward position of the medial side portion.

18. The insole of claim 14, wherein the bottom of the arch transition portion is generally concave and configured to extend along a wearer's arch.

* * * * *